US007632360B2

(12) United States Patent
Mori et al.

(10) Patent No.: US 7,632,360 B2
(45) Date of Patent: Dec. 15, 2009

(54) RARE EARTH MAGNET POWDER AND METHOD OF PRODUCING THE SAME

(75) Inventors: Katsuhiko Mori, Naka-gun (JP); Ryoji Nakayama, Naka-gun (JP); Hideaki Ono, Yokohama (JP); Takae Ono, legal representative, Yokohama (JP); Tetsurou Tayu, Yokosuka (JP); Munekatsu Shimada, Tokyo (JP); Makoto Kano, Yokohama (JP); Yoshio Kawashita, Yokosuka (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 528 days.

(21) Appl. No.: 10/569,429

(22) PCT Filed: May 13, 2004

(86) PCT No.: PCT/JP2004/006784

§ 371 (c)(1),
(2), (4) Date: Feb. 23, 2006

(87) PCT Pub. No.: WO2005/023462

PCT Pub. Date: Mar. 17, 2005

(65) Prior Publication Data

US 2007/0079904 A1 Apr. 12, 2007

(30) Foreign Application Priority Data

Aug. 27, 2003 (JP) ..... 2003-209090
Aug. 29, 2003 (JP) ..... 2003-209477
Oct. 30, 2003 (JP) ..... 2003-370054

(51) Int. Cl.
*H01F 1/057* (2006.01)

(52) U.S. Cl. ..... 148/302; 428/403; 148/101; 148/105; 148/122

(58) Field of Classification Search ..... None
See application file for complete search history.

(56) References Cited

FOREIGN PATENT DOCUMENTS

| | | | |
|---|---|---|---|
| EP | 0 411 571 A2 | | 2/1991 |
| EP | 1 191 553 A2 | | 3/2002 |
| JP | 3-129703 | | 6/1991 |
| JP | 9-165601 | | 6/1997 |
| JP | 2002-93610 | | 3/2002 |
| JP | 2003-193208 | | 7/2003 |
| JP | 2005-97711 | * | 4/2005 |

* cited by examiner

*Primary Examiner*—John P. Sheehan
(74) *Attorney, Agent, or Firm*—Kratz, Quintos & Hanson, LLP

(57) ABSTRACT

A rare earth magnet powder has a chemical composition which includes R: 5 to 20% (wherein, R represents one or two or more rare earth elements being inclusive of Y but exclusive of Dy and Tb), one or two of Dy and Tb: 0.01 to 10%, and B: 3 to 20%, with the balance comprising Fe and inevitable impurities; and an average particle diameter of 10 to 1,000 μm, wherein 70% or more of the entire surface of the rare earth magnet powder is covered with a layer being rich in the content of one or two of Dy and Tb and having a thickness of 0.05 to 50 μm.

7 Claims, 5 Drawing Sheets

RARE EARTH MAGNET POWDER AND METHOD OF PRODUCING THE SAME

TECHNICAL FIELD

The present invention relates to a rare earth magnet powder which is excellent in magnetic anisotropy and thermal stability and method of producing the same.

BACKGROUND ART

A known method of producing a rare earth magnet powder which is excellent in magnetic anisotropy includes mixing a rare earth magnet alloy raw material hydride powder having a chemical composition which includes, in atom % (hereinafter % represents atom %), one, or two or more rare earth element including Y: 10 to 20%, Co: 0 to 50%, B: 3 to 20%, and M: 0 to 5% (wherein M represents one, or two or more from among Ga, Zr, Nb, Mo, Hf, Ta, W, Ni, Al, Ti, V, Cu, Cr, Ge, C, and Si), with the balance including Fe and inevitable impurities, and a powder including Dy and Tb in an elemental, alloy, or compound form, or in hydrides thereof (an elemental, alloy, or compound form) so as to produce a mixed powder; diffusion heat-treating the mixed powder; and then carrying out hydrogen absorption of the diffusion heat-treated mixed powder.

The aforementioned rare earth magnet alloy raw material hydride powder is produced by the following known method: carrying out hydrogen absorption by heating, or heating and holding a rare earth magnet alloy raw material from room temperature to a temperature below 500° C. in a hydrogen atmosphere; carrying out hydrogen absorption-decomposition by heating and holding the rare earth magnet alloy raw material at a predetermined temperature in a range of 500 to 1,000° C. in a hydrogen atmosphere with a pressure of 10 to 1,000 kPa so as to induce the rare earth magnet alloy raw material to absorb hydrogen and to be decomposed due to a phase transformation; carrying out heat treatment in depressurized hydrogen with some hydrogen remaining in the rare earth magnet alloy raw material by holding the rare earth magnet alloy raw material subjected to the hydrogen absorption-decomposition at a predetermined temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa; and then cooling the rare earth magnet alloy raw material to room temperature by introducing Ar gas (see Patent document 1: Japanese Patent Application, First Publication No. 2002-93610).

Also, in the case of producing a magnetically anisotropic HDDR magnet powder that is the aforementioned rare earth magnet powder, the following method is used: carrying out hydrogen absorption for a rare earth magnet alloy raw material; carrying out hydrogen absorption-decomposition by heating and holding the rare earth magnet alloy raw material at a predetermined temperature in a range of 500 to 1,000° C. in a hydrogen atmosphere with a pressure of 10 to 1,000 kPa so as to induce the rare earth magnet alloy raw material to absorb hydrogen and to be decomposed due to a phase transformation; and then carrying out hydrogen desorption by holding the rare earth magnet alloy raw material subjected to the hydrogen absorption at a predetermined temperature in a range of 500 to 1,000° C. in vacuum. Accordingly, the magnet obtained by the aforementioned method is known to have a recrystallization texture in which recrystallized grains, whose main phase is a $R_2Fe_{14}B$ intermetallic compound phase that is substantially a tetragonal structure, are adjacent to each other, and the recrystallization texture includes a basic texture of a magnetically anisotropic HDDR magnet powder in which the recrystallized rains, whose ratio (b/a) of a longest particle diameter (b) to a shortest particle diameter (a) is less than 2, exists at 50 vol % or more of all the recrystallized grains and an average recrystallized grain diameter of the recrystallized grains is 0.05 to 5 μm (see Patent document 2: Japanese Patent No. 2576672).

Recently, in the electrical and electronics industries, a need has arisen for a rare earth magnet powder which is further excellent in magnetic anisotropy. In the automotive industry in particular, active development work is being carried out on electric vehicles, including the motors to be mounted in such vehicles. The motors that are mounted in such electric vehicles are sometimes installed close to a small gasoline engine or left out under the scorching sun, so it is not unusual for them to be placed in an environment where they are particularly subjected to heating. Accordingly, there exists a need for a rare earth magnet powder which is so excellent in thermal stability and magnetic anisotropy including both coercivity and remanence that it can be used to produce motor components which is further excellent in heat resistance and magnetic properties.

DISCLOSURE OF INVENTION

The present inventors have conducted research with the aim of obtaining a rare earth magnet powder which is further excellent in magnetic anisotropy and thermal stability. In consequence, the research results described in (i) to (iii) below were obtained.

(i) (a) A rare earth magnet powder having a chemical composition which includes, in atom % (hereinafter % represents atom %), R: 5 to 20% (wherein R represents one, or two or more rare earth elements being inclusive of Y but exclusive of Dy and Tb; the same applies below), one or both of Dy and Tb: 0.01 to 10%, and B: 3 to 20%, with the balance including Fe and inevitable impurities, an average particle diameter being 10 to 1,000 μm, wherein 70% or more of the entire surface of the rare earth magnet powder is covered with a layer being rich in content of the one or both of Dy and Tb and having a thickness of 0.05 to 50 μm (hereinafter referred to as a "Dy—Tb rich layer"), and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(b) A rare earth magnet powder having a chemical composition which includes R: 5 to 20%, one or both of Dy and Tb: 0.01 to 10%, B: 3 to 20%, and M: 0.001 to 5% (wherein M represents one, or two or more from among Ga, Zr, Nb, Mo, Hf, Ta, W, Ni, Al, Ti, V, Cu, Cr, Ge, C, and Si), with the balance including Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(c) A rare earth magnet powder having a chemical composition which includes R: 5 to 20%, Co: 0.1 to 50%, one or both of Dy and Tb: 0.01 to 10%, and B: 3 to 20%, with the balance including Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(d) A rare earth magnet powder having a chemical composition which includes R: 5 to 20%, Co: 0.1 to 50%, one or both of Dy and Tb: 0.01 to 10%, and B: 3 to 20%, with the balance including Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

Each of the rare earth magnet powders described in (a) to (d) above is further excellent in magnetic anisotropy and thermal stability than the conventional rare earth magnet powder described in Patent document 1.

(ii) Each of the rare earth magnet powders has a recrystallization texture in which recrystallized grains, whose main phase is a $R_2Fe_{14}B$ intermetallic compound phase that is substantially a tetragonal structure, are adjacent to each other, and the recrystallization texture includes a basic texture of a magnetically anisotropic HDDR magnet powder in which the recrystallized grains, whose ratio (b/a) of a longest particle diameter (b) to a shortest particle diameter (a) is less than 2, exists at 50 vol % or more of all the recrystallized grains and an average recrystallized grain diameter of the recrystallized grains is 0.05 to 5 μm.

(iii) These rare earth magnet powders having magnetic anisotropy and thermal stability can be used to produce rare earth magnets by conventional methods.

For the purpose of producing the aforementioned rare earth magnet powders which are further excellent magnetic anisotropy and thermal stability, (A) the following steps are used in the aforementioned conventional method of producing a rare earth magnet powder which is excellent in magnetic anisotropy: milling a rare earth magnet alloy raw material in a conventional inert gas atmosphere to an average powder particle diameter of 10 to 1,000 μm so as to produce a rare earth magnet alloy raw material powder; adding to the rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; carrying out hydrogen absorption by heating, or heating and holding the mixed powder from room temperature to a temperature below 500° C. in a hydrogen gas atmosphere with a pressure of 10 to 1,000 kPa so as to induce the mixed powder to absorb hydrogen; and then carrying out hydrogen absorption-decomposition by heating and holding the mixed powder at a temperature in a range of 500 to 1,000° C. in a hydrogen gas atmosphere with a pressure of 10 to 1,000 kPa so as to induce the mixed powder to absorb hydrogen and to be decomposed. Subsequently, as in the case of the conventional method, the following steps are used if necessary: carrying out intermediate heat treatment by holding the mixed powder subjected to the hydrogen absorption-decomposition at a predetermined temperature in a range of 500 to 1,000° C. in an inert gas atmosphere with an inert gas pressure of 10 to 1,000 kPa; and/or carrying out heat treatment in depressurized hydrogen with some hydrogen remaining in the mixed powder by holding the mixed powder subjected to the intermediate heat treatment at a predetermined temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa. Finally, the following step is used: carrying out hydrogen desorption by holding the mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing, thereby producing the aforementioned rare earth magnet powders which are further excellent magnetic anisotropy and thermal stability.

(B) Alternatively, the following steps are used: if necessary, subjecting a rare earth magnet alloy raw material to hydrogen absorption by heating, or heating and holding the rare earth magnet alloy raw material from room temperature to a temperature below 500° C. in a hydrogen gas atmosphere with a pressure of 10 to 1,000 kPa so as to induce the rare earth magnet alloy raw material to absorb hydrogen; milling the hydrogen-absorbing rare earth magnet alloy raw material to an average powder particle diameter of 10 to 1,000 μm so as to produce a rare earth magnet alloy raw material powder subjected to the hydrogen absorption (hereinafter referred to as a "hydrogen-absorbing rare earth magnet alloy raw material powder"); adding to a hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; and then carrying out hydrogen absorption-decomposition by heating and holding the hydrogen-containing raw material mixed powder at a temperature in a range of 500 to 1,000° C. in a hydrogen gas atmosphere with a pressure of 10 to 1,000 kPa so as to induce the hydrogen-containing raw material mixed powder to absorb further hydrogen and to be decomposed. Subsequently, the following steps are used if necessary: carrying out intermediate heat treatment by holding the hydrogen-containing raw material mixed powder subjected to the hydrogen absorption-decomposition at a temperature in a range of 500 to 1,000° C. in an inert gas atmosphere with a pressure of 10 to 1,000 kPa; and/or carrying out heat treatment in depressurized hydrogen with some hydrogen remaining in the hydrogen-containing raw material mixed powder by holding the hydrogen-containing raw material mixed powder subjected to the intermediate heat treatment at a temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa. Finally, the following step is used: carrying out hydrogen desorption by holding the hydrogen-containing raw material mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing, so as to be able to produce the rare earth magnet powders which are further excellent magnetic anisotropy and thermal stability.

It is preferable that the aforementioned rare earth magnet alloy raw material has a chemical composition, in atom % (hereinafter % represents atom %), including R': 10 to 20% (wherein R' represents one, or two or more rare earth elements being inclusive of Y but exclusive of Dy and Tb; the same applies below) and B: 3 to 20%, with the balance including Fe and inevitable impurities; a chemical composition including R': 10 to 20%, B: 3 to 20%, and M: 0.001 to 5% (wherein M represents one, or two or more from among Ga, Zr, Nb, Mo, Hf, Ta, W, Ni, Al, Ti, V, Cu, Cr, Ge, C, and Si), with the balance including Fe and inevitable impurities; a chemical composition including R': 10 to 20%, Co: 0.1 to 50%, and B: 3 to 20%, with the balance including Fe and inevitable impurities; ora chemical composition including R': 10 to 20%, Co: 0.1 to 50%, B: 3 to 20%, and M: 0.001 to 5%, with the balance including Fe and inevitable impurities.

The present invention was achieved on the basis on these research results, and is characterized in the following.

(1) A rare earth magnet powder having a chemical composition which includes, in atom % (hereinafter % represents atom %), R: 5 to 20% (wherein R represents one, or two or more rare earth elements being inclusive of Y but exclusive of Dy and Tb; the same applies below), one or both of Dy and Tb: 0.01 to 10%, and B: 3 to 20%, with the balance including Fe and inevitable impurities, an average particle diameter being 10 to 1,000 μm, wherein 70% or more of the entire surface of the rare earth magnet powder is covered with a layer being rich in content of the one or both of Dy and Tb and having a thickness of 0.05 to 50 μm (hereinafter referred to as a "Dy—Tb rich layer"), and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(2) A rare earth magnet powder having a chemical composition which includes R: 5 to 20%, one or both of Dy and Tb: 0.01 to 10%, B: 3 to 20%, and M: 0.001 to 5% (wherein M represents one, or two or more from among Ga, Zr, Nb, Mo, Hf, Ta, W, Ni, Al, Ti, V, Cu, Cr, Ge, C, and Si), with the balance including Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(3) A rare earth magnet powder having a chemical composition which includes R: 5 to 20%, Co: 0.1 to 50%, one or both of Dy and Tb: 0.01 to 10%, and B: 3 to 20%, with the balance including Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(4) A rare earth magnet powder having a chemical composition which includes R: 5 to 20%, one or both of Dy and Tb: 0.01 to 10%, Co: 0.1 to 50%, B: 3 to 20%, and M: 0.001 to 5%, with the balance including Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

(5) A rare earth magnet produced by binding a rare earth magnet powder which is excellent in magnetic anisotropy and thermal stability according to any one of claims (1) to (4) with an organic binder or a metal binder.

(6) A rare earth magnet produced by processing a rare earth magnet powder which is excellent in magnetic anisotropy and thermal stability according to any one of claims (1) to (4) with hot pressing or hot isostatic pressing.

(7) A method of producing a rare earth magnet powder, including: milling a rare earth magnet alloy raw material in an inert gas atmosphere to an average powder particle diameter of 10 to 1,000 μm so as to produce a rare earth magnet alloy raw material powder; adding to the rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; carrying out hydrogen absorption by heating, or heating and holding the mixed powder from room temperature to a temperature below 500° C. in a hydrogen gas atmosphere with a pressure of 10 to 1,000 kPa so as to induce the mixed powder to absorb hydrogen; carrying out hydrogen absorption-decomposition by heating and holding the mixed powder at a temperature in a range of 500 to 1,000° C. in a hydrogen gas atmosphere with a pressure of 10 to 1,000 kPa so as to induce the mixed powder to absorb hydrogen and to be decomposed; and then carrying out hydrogen desorption by holding the mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(8) A method of producing a rare earth magnet powder, including: milling a rare earth magnet alloy raw material in an inert gas atmosphere to an average powder particle diameter of 10 to 1,000 μm so as to produce a rare earth magnet alloy raw material powder; adding to the rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; carrying out hydrogen absorption by heating, or heating and holding the mixed powder from room temperature to a temperature below 500° C. in a hydrogen gas atmosphere with a pressure of 10 to 1,000 kPa so as to induce the mixed powder to absorb hydrogen; carrying out hydrogen absorption-decomposition by heating and holding the mixed powder at a temperature in a range of 500 to 1,000° C. in a hydrogen gas atmosphere with a pressure of 10 to 1,000 kPa so as to induce the mixed powder to absorb hydrogen and to be decomposed; carrying out intermediate heat treatment by holding the mixed powder subjected to the hydrogen absorption-decomposition at a temperature in a range of 500 to 1,000° C. in an inert gas atmosphere with a pressure of 10 to 1,000 kPa; and then carrying out hydrogen desorption by holding the powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(9) A method of producing a rare earth magnet powder, including: milling a rare earth magnet alloy raw material in an inert gas atmosphere to an average powder particle diameter of 10 to 1,000 μm so as to produce a rare earth magnet alloy raw material powder; adding to the rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; carrying out hydrogen absorption by heating, or heating and holding the mixed powder from room temperature to a temperature below 500° C. in a hydrogen gas atmosphere with a pressure of 10 to 1,000 kPa so as to induce the mixed powder to absorb hydrogen; carrying out hydrogen absorption-decomposition by heating and holding the mixed powder at a temperature in a range of 500 to 1,000° C. in a hydrogen gas atmosphere with a pressure of 10 to 1,000 kPa so as to induce the mixed powder to absorb hydrogen and to be decomposed; carrying out heat treatment in depressurized hydrogen with some hydrogen remaining in the mixed powder by holding the mixed powder subjected to the hydrogen absorption-decomposition at a temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa; and then carrying out hydrogen desorption by holding the powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(10) A method of producing a rare earth magnet powder, including: milling a rare earth magnet alloy raw material in an inert gas atmosphere to an average powder particle diameter of 10 to 1,000 μm so as to produce a rare earth magnet alloy raw material powder; adding to the rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; carrying out hydrogen absorption by heating, or heating and holding the mixed powder from room temperature to a temperature below 500° C. in a hydrogen gas atmosphere with a pressure of 10 to 1,000 kPa so as to induce the mixed powder to absorb hydrogen; carrying out hydrogen absorption-decomposition by heating and holding the mixed powder at a temperature in a range of 500 to 1,000° C. in a hydrogen gas atmosphere with a pressure of 10 to 1,000 kPa so as to induce the mixed powder to absorb hydrogen and to be decomposed; carrying out intermediate heat treatment by holding the mixed powder subjected to the hydrogen absorption-decomposition at a temperature in a range of 500 to 1,000° C. in an inert gas atmosphere with a pressure of 10 to 1,000 kPa; carrying out heat treatment in depressurized hydrogen with some hydrogen remaining in the mixed powder by holding the mixed powder subjected to the intermediate heat treatment at a temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa; and then carrying out hydrogen desorption by holding the powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(11) A method of producing a rare earth magnet powder according to any one of (7) to (10), wherein the rare earth magnet alloy raw material has been homogenized by holding in a vacuum or Ar gas atmosphere at a temperature of 600 to 1,200° C.

(12) A method of producing a rare earth magnet powder, including: subjecting a rare earth magnet alloy raw material to hydrogen absorption by heating, or heating and holding the rare earth magnet alloy raw material from room temperature to a temperature below 500° C. in a hydrogen gas atmosphere with a pressure of 10 to 1,000 kPa so as to induce the rare earth magnet alloy raw material to absorb hydrogen; milling the hydrogen-absorbing rare earth magnet alloy raw material to an average powder particle diameter of 10 to 1,000 μm so as to produce a rare earth magnet alloy raw material powder subjected to the hydrogen absorption (hereinafter referred to as a "hydrogen-absorbing rare earth magnet alloy raw material powder"); adding to the hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; carrying out hydrogen absorption-decomposition by heating and holding the hydrogen-containing raw material mixed powder at a temperature in a range of 500 to 1,000° C. in a hydrogen gas atmosphere with a pressure of 10 to 1,000 kPa so as to induce the hydrogen-containing raw material mixed powder to absorb further hydrogen and to be decomposed; and then carrying out hydrogen desorption by holding the hydrogen-containing raw material mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(13) A method of producing a rare earth magnet powder, including: adding to a hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; carrying out hydrogen absorption-decomposition by heating and holding the hydrogen-containing raw material mixed powder at a temperature in a range of 500 to 1,000° C. in a hydrogen gas atmosphere with a pressure of 10 to 1,000 kPa so as to induce the hydrogen-containing raw material mixed powder to absorb further hydrogen and to be decomposed; carrying out intermediate heat treatment by holding the hydrogen-containing raw material mixed powder subjected to the hydrogen absorption-decomposition at a temperature in a range of 500 to 1,000° C. in an inert gas atmosphere with a pressure of 10 to 1,000 kPa; and then carrying out hydrogen desorption by holding the hydrogen-containing raw material mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(14) A method of producing a rare earth magnet powder, including: adding to a hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; carrying out hydrogen absorption-decomposition by heating and holding the hydrogen-containing raw material mixed powder at a temperature in a range of 500 to 1,000° C. in a hydrogen gas atmosphere with a pressure of 10 to 1,000 kPa so as to induce the hydrogen-containing raw material mixed powder to absorb further hydrogen and to be decomposed; carrying out heat treatment in depressurized hydrogen with some hydrogen remaining in the hydrogen-containing raw material mixed powder by holding the hydrogen-containing raw material mixed powder subjected to the hydrogen absorption-decomposition at a temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa; and then carrying out hydrogen desorption by holding the hydrogen-containing raw material mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(15) A method of producing a rare earth magnet powder, including: adding to a hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; carrying out hydrogen absorption-decomposition by heating and holding the hydrogen-containing raw material mixed powder at a temperature in a range of 500 to 1,000° C. in a hydrogen gas atmosphere with a pressure of 10 to 1,000 kPa so as to induce the hydrogen-containing raw material mixed powder to absorb further hydrogen and to be decomposed; carrying out intermediate heat treatment by holding the hydrogen-containing raw material mixed powder subjected to the hydrogen absorption-decomposition at a temperature in a range of 500 to 1,000° C. in an inert gas atmosphere with a pressure of 10 to 1,000 kPa; and then carrying out heat treatment in depressurized hydrogen with some hydrogen remaining in the hydrogen-containing raw material mixed powder by holding the hydrogen-containing raw material mixed powder subjected to the intermediate heat treatment at a temperature in a range of 500 to 1,000° C. in a hydrogen atmosphere with an absolute pressure of at least 0.65 but less than 10 kPa or in a mixed hydrogen/inert gas atmosphere with a hydrogen partial pressure of at least 0.65 but less than 10 kPa; and then carrying out hydrogen desorption by holding the hydrogen-containing raw material mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

(16) A method of producing a rare earth magnet powder according to any one of (12) to (15), wherein a rare earth magnet alloy raw material for producing the hydrogen-absorbing rare earth magnet alloy raw material powder has been homogenized by holding in a vacuum or Ar gas atmosphere at a temperature of 600 to 1,200° C.

(17) A method of producing a rare earth magnet, including binding a rare earth magnet powder which is excellent in magnetic anisotropy and thermal stability produced by the method according to any one of (7) to (16) with an organic binder or a metal binder.

(18) A method of producing a rare earth magnet, including: molding a rare earth magnet powder which is excellent in magnetic anisotropy and thermal stability produced by the method according to any one of (7) to (16) so as to produce a green compact; and processing the green compact with hot pressing or hot isostatic pressing at a temperature of 600 to 900° C.

(19) A method of producing a rare earth magnet powder according to any one of (7) to (16), wherein the rare earth magnet alloy raw material has: a chemical composition, in atom % (hereinafter % represents atom %), including R': 10 to 20% (wherein R' represents one, or two or more rare earth elements being inclusive of Y but exclusive of Dy and Tb; the same applies below) and B: 3 to 20%, with the balance including Fe and inevitable impurities; a chemical composition including R': 10 to 20%, B: 3 to 20%, and M: 0.001 to 5% (wherein M represents one, or two or more from among Ga, Zr, Nb, Mo, Hf, Ta, W, Ni, Al, Ti, V, Cu, Cr, Ge, C, and Si), with the balance including Fe and inevitable impurities; a chemical composition including R': 10 to 20%, Co: 0.1 to 50%, and B: 3 to 20%, with the balance including Fe and inevitable impurities; or a chemical composition including R': 10 to 20%, Co: 0.1 to 50%, B: 3 to 20%, and M: 0.001 to 5%, with the balance including Fe and inevitable impurities.

Rare earth magnet powders obtained by the methods of producing a rare earth magnet powder of the present invention, which includes, in order, producing a rare earth magnet alloy raw material powder or a hydrogen-absorbing rare earth magnet alloy raw material powder; adding to the rare earth magnet alloy raw material powder a Dy hydride powder, a Tb hydride powder, or a Dy—Tb binary alloy hydride powder at 0.01 to 5 mol %, followed by mixing so as to produce a mixed powder; hydrogen absorption; hydrogen absorption-decomposition; optional intermediate heat treatment; optional heat treatment in depressurized hydrogen; and then hydrogen desorption, are excellent in magnetic anisotropy and thermal stability, and thus exhibits industrially advantageous effects.

BEST MODE FOR CARRYING OUT THE INVENTION

Figure 1:
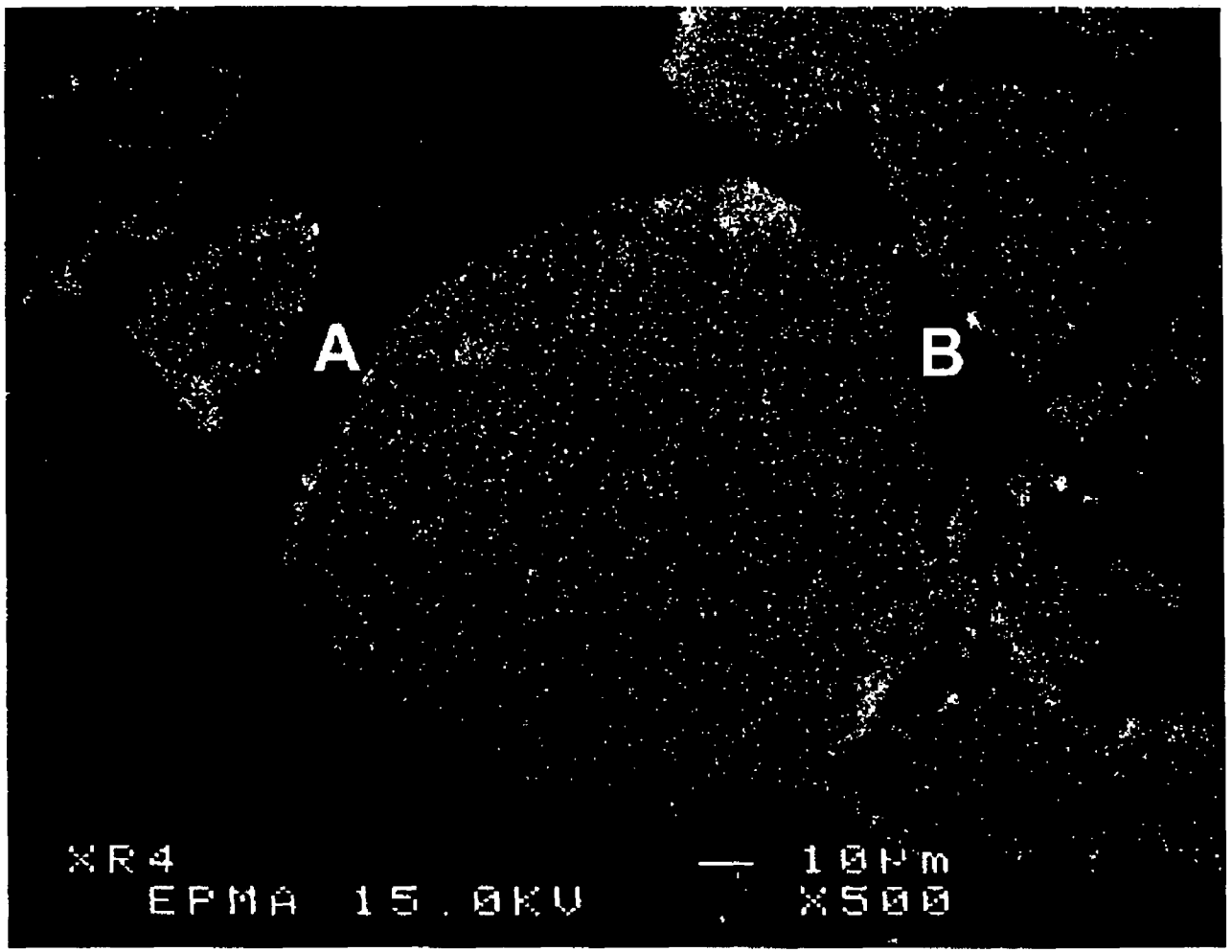
FIG. 1 is an elemental distribution image obtained by using an electron probe microanalyzer (EPMA), which shows the elemental distribution of Dy contained in the anisotropic magnet powder produced by the present invention's method 1.

Hereinafter, the reasons are described for restricting the chemical composition and the texture of a rare earth magnet powder of the present invention, as well as for restricting the production condition and the addition amount of a Dy hydride powder, a Tb hydride powder, or a Dy—Tb binary alloy hydride powder added to a rare earth magnet alloy raw material powder or a hydrogen-absorbing rare earth magnet alloy raw material powder in a method of producing a rare earth magnet powder which is excellent in magnetic anisotropy and thermal stability of the present invention, as described above.

(A) Rare Earth Magnet Powder (i) Reasons for Restricting Chemical Compositions

R:

R is a rare earth element which primarily includes Nd and also includes small amounts of, for example, Y, Pr, Sm, Ce, La, Er, Eu, Gd, Tm, Yb, Lu, and Ho (but excludes Dy and Tb). When the content of R is less than 5%, coercivity decreases, while when the content of R is more than 20%, saturation magnetization decreases; thus, the desired magnetic properties cannot be achieved in either of these cases. Therefore, the content of R has been set at 5 to 20%.

Dy and Tb:

The content of one or both of Dy and Tb has been set at 0.01 to 10% (particularly preferably 0.3 to 4%). The reasons thereof are as follows. When the content of one or both of Dy and Tb is less than 0.01%, the desired effects of the present invention that is excellent magnetic anisotropy and thermal stability cannot be obtained, while when the content of one or both of Dy and Tb is more than 10%, anisotropy 5 decreases and appropriate magnetic properties cannot be obtained.

B:

When the content of B is less than 3%, coercivity decreases, while when the content of B is more than 20%, saturation magnetization decreases; thus, the desired magnetic properties cannot be achieved in either of these cases. Therefore, the content 10 of B has been set at 3 to 20%.

Co:

Co is optionally added to prevent the rare earth magnet alloy from changing to an isotropic state. When the content of Co is less than 0.1%, the desired effect cannot be obtained, while when the content of Co is more than 50%, coercivity and saturation magnetization decreases, so high properties cannot be obtained even if the rare earth magnet alloy becomes in an anisotropic state. Therefore, the content of Co has been set at 0.1 to 50% (particularly preferably 5 to 30%), which is contained in a rare earth magnet powder of the present invention and a rare earth magnet alloy raw material used in a method of producing a rare earth magnet powder of the present invention.

M (One, or Two or More from Among Ga, Zr, Nb, Mo, Hf, Ta, W, Ni, Al, Ti, V, Cu, Cr, Ge, C and Si):

M is optionally added to furter improve coercivity and remanence. When the content of M is less than 0.001%, the desired effect cannot be obtained, while when the content of M is more than 5%, the coercivity and the remanence decrease. Therefore, the content of M has been set at 0.001 to 5%.

(ii) Reasons for Restricting Textures

Maximum Detected Intensity in Line Analysis by Using Wavelength Dispersive X-ray Spectroscopy:

The maximum detected intensity of one or both of Dy and Tb near the surface can be obtained as follows: scanning across a powder cross-section in line analysis by using wavelength dispersive X-ray spectroscopy; obtaining the average detected intensity in the central portion being present in the range of ⅓ of the particle diameter of a powder particle and referring to this as a near-center intensity; and determining the maximum detected intensity of one or both of Dy and Tb at a peak near the surface as a ratio relative to the near-center intensity. Herein, the place sometimes appears where the detected intensity of one or both of Dy and Tb is locally very large, while this is usually due to the presence of a rare earth rich phase, and it is a characteristic of this phase that, in addition to one or both of Dy and Tb, the detected intensity of one or both of Nd and Pr also increases at the same time. Because such a phase inevitably occurs in the present invention, it shall be excluded from assessments of the maximum detected intensity. Also, when the maximum detected intensity of one or both of Dy and Tb by using wavelength dispersive X-ray spectroscopy here is less than 1.2 times the near-center intensity, because of the small anisotropic magnetic field difference between the surface and the interior of a powder particle, the desired effect of achieving both large coercivity due to a highly anisotropic magnetic field at the surface and large anisotropy at the interior cannot be obtained. Also, when the detected intensity is more than 5 times the near-center intensity, magnetic flux density in the near-surface region decreases remarkably. Therefore, the detected intensity of one or both of Dy and Tb in the near-surface region by using wavelength dispersive X-ray spectroscopy has been set at 1.2 to 5 times (preferably 1.3 to 4 times) the detected intensity at the interior.

Thickness of Dy—Tb Rich Layer from Surface:

The depth, from the surface, of the region being rich in content of one or both of Dy and Tb (Dy—Tb rich layer) which is present at the surface of the rare earth magnet powder can be obtained as follows: scanning across the vicinity of the surface in a powder cross-section at as fine intervals as possible in line analysis by using wavelength dispersive X-ray spectroscopy; and determining the width of a portion in which the detected intensity of a peak is at least 1.2 times the average detected intensity near the center as the depth of the region of the region being rich in content of one or both of Dy and Tb from the surface. Herein, when a Dy—Tb rich phase in which a detected intensity of one or both of Dy and Tb is locally very high exists in the scanned area, this area is excluded from assessment of the depth from the surface. It is believed that, in a Dy—Tb rich layer, one or both of Dy and Tb substitutes for an R atom of a $R_2(Fe,Co)_{14}B$ crystal grain near the surface so as to form a $(R,(Dy,Tb))_2(Fe,Co)_{14}B$ phase and that the effects of the present invention are obtained by the substitution resulting in one or more layer of crystal grains at the surface having more one or both of Dy and Tb than at the interior of a particle. However, the desired effects are not obtained when the Dy—Tb rich layer which is the region being rich in content of one or both of Dy and Tb has a thickness of less than 0.05 μm. On the other hand, when the Dy—Tb rich layer has a thickness of more than 50 μm, the volume of the region having the high content of one or both of Dy and Tb and large coercivity has an influence on the highly anisotropic region at the interior, so as to remarkably lower the anisotropy of the powder as a whole. Accordingly, the depth of the Dy—Tb rich layer from the surface has been set at 0.05 to 50 μm (preferably 1 to 30 μm).

Surface Coverage of Dy—Tb Rich Layer:

The surface coverage of the region being rich in content of one or both of Dy and Tb (Dy—Tb rich layer) is obtained as follows: carrying out five or more line analyses at different scanning positions on a single powder cross-section in line analysis by wavelength dispersive X-ray spectroscopy; and determining the surface coverage of a Dy—Tb rich layer as the ratio of the number of powder surfaces, for which the sum of the detected intensity of one or both of Dy and Tb near the surface of the powder is at least 1.2 times that near the center, to the number of times the powder surfaces were crossed by scanning. Herein, when a rare earth rich phase in which a detected intensity of one or both of Dy and Tb is locally very high exists in the scanned area, this area is excluded from the count. The surface of the powder is covered by the region having a strong anisotropic magnetic field and being rich in content of one or both of Dy and Tb which are elements being less readily oxidized than Nd, so the powder has large coercivity and large anisotropy, and excellent resistance to oxidation can be obtained. However, when less than 70% of the surface is covered by the region, sufficiently large coercivity cannot be obtained, and the resistance to oxidation is also insufficient, so sufficient thermal stability and heat resistance cannot be obtained. Accordingly, the surface area covered by the region being rich in content of one or both of Dy and Tb has been set at 70% or more (preferably 80% or more) of the entire surface of the powder.

In the rare earth magnet powder of the present invention, it is believed that the coercivity of the powder is improved because the region being rich in content of one or both of Dy and Tb (Dy—Tb rich layer) near the surface at the powder interior has a higher anisotropic magnetic field than vicinity of the center. Moreover, it is believed that the thermal stability and the heat resistance of the powder are improved because Dy and Tb are relatively resistant to oxidation and improve the resistance to oxidation of the powder. In addition, it is believed that the anisotropy of the powder as a whole rarely decreases because the region being rich in content of one or both of Dy and Tb (Dy—Tb rich layer) is restricted to the vicinity of the powder surface. This is most likely why the powder exhibits both good heat resistance and high anisotropy.

(B) Reasons for Restricting the Production Conditions in the Methods of Producing a Rare Earth Magnet Powder which is Excellent in Magnetic Anisotropy and Thermal Stability Described in Any One of the Aforementioned (7) to (11):

The reasons for milling the rare earth magnet alloy raw material to an average particle diameter of 10 to 1,000 μm (preferably 50 to 400 μm) are as follows. When fine milling to an average particle diameter of below 10 μm is attempted in an inert gas atmosphere, the oxidation of the alloy due to heat generation during milling is unavoidable because of the very small particle diameter, whereby the coercivity of the rare earth magnet powder ultimately obtained is unfavorably lowered. On the other hand, when an average particle diameter is longer than 1,000 μm, Dy, Tb, or a Dy—Tb binary alloy is not able to diffuse to the center portion of the rare earth magnet alloy raw material powder, resulting in an inhomogeneous composition. Then, the axis of easy magnetization in each particle of the rare earth magnet powder ultimately obtained by pulverizing is difficult to align, so the magnetic anisotropy is unfavorably lowered.

A rare earth magnet powder which is further excellent magnetic anisotropy and thermal stability can be obtained by the following method including: adding to the aforementioned rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; carrying out hydrogen absorption by heating, or heating and holding the mixed powder from room temperature to a temperature below 500° C. in a hydrogen gas atmosphere with a pressure of 10 to 1,000 kPa so as to induce the mixed powder to absorb hydrogen; carrying out hydrogen absorption-decomposition by heating and holding the mixed powder at a temperature in a range of 500 to 1,000° C. in a hydrogen gas atmosphere with a pressure of 10 to 1,000 kPa so as to induce the mixed powder to absorb hydrogen and to be decomposed; and then carrying out hydrogen desorption by holding the mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

When the mixed powder obtained by adding to the aforementioned rare earth magnet alloy raw material powder a Dy hydride powder, a Tb hydride powder or a Dy—Tb binary alloy hydride powder, followed by mixing, is subjected to hydrogen absorption; hydrogen absorption-decomposition; and then hydrogen desorption, a rare earth magnet powder which is further excellent in magnetic anisotropy and thermal stability is obtained. The following reasons are believed for this.

It has been found from recent research that the reactions at the stage of hydrogen absorption-decomposition are important in the case of anisotropizing a rare earth magnet powder by subjecting a rare earth magnet alloy raw material powder to the treatment including, in turn, hydrogen absorption, hydrogen absorption-decomposition, and then hydrogen desorption (which is generally referred to as HDDR treatment). On the other hand, when a large amount of one or both of Dy and Tb is added to the rare earth magnet alloy in an attempt to increase coercivity for the purpose of the thermal stability, as described in Patent document (Japanese Patent Application, First Publication No. 1997-165601), anisotropy decreases, and a sufficient energy product cannot be obtained. This is probably because the inclusion of a large amount of one or both of Dy and Tb in the rare earth magnet alloy affects the reactions of the aforementioned hydrogen absorption-decomposition; therefore, the state formed by the hydrogen absorption-decomposition reactions does not satisfy the conditions for anisotropization.

However, when the mixed powder, which is produced by adding a Dy hydride powder, a Tb hydride powder, or a Dy—Tb binary alloy hydride powder to the rare earth magnet alloy raw material powder obtained by milling in an ordinary inert gas atmosphere, followed by mixing, is subjected to the hydrogen absorption-decomposition as in the present invention, the decomposition reactions at that time proceed toward the formation of rare earth element hydrides formed from the rare earth magnet alloy and the decomposition of the residue into the phase primarily including Fe or (Fe,Co), and $Fe_2B$. Because a Dy hydride powder, a Tb hydride powder, or a Dy—Tb binary alloy hydride powder, which is a rare earth element, does not take part in these decomposition reactions, only the rare earth magnet alloy raw material powder is decomposed. Therefore, unlike when a large amount of one or both of Dy and Tb is added to a rare earth magnet alloy, the state formed by the hydrogen absorption-decomposition reactions does not fail to satisfy the conditions for anisotropization.

Subsequently, when hydrogen desorption is carried out from the aforementioned state, the phase primarily including R hydrides, Fe or (Fe,Co), and $Fe_2B$, which have been decomposed in the rare earth magnet alloy raw material powder, reacts so as to form a $R_2Fe_{14}B$-based phase. In addition, a Dy hydride powder, a Tb hydride powder, or a Dy—Tb binary alloy hydride powder also releases hydrogen, so one or both atoms of Dy and Tb diff-use in the entire surface of the rare earth magnet alloy raw material powder, and then diff-use into the interior of the rare earth magnet alloy raw material powder. Therefore, the $R_2Fe_{14}B$-based phase that is ultimately formed has a higher content of one or both of Dy and Tb than the original rare earth magnet alloy raw material powder, and the content of one or both of Dy and Tb near the surface in each powder particle is higher than the content near the center therein. As a result, coercivity is improved, and the temperature coefficient of coercivity decreases, thereby improving the thermal stability. Meanwhile, the following reason can also be believed. The conditions for anisotropization are satisfied at the stage of the hydrogen absorption-decomposition reactions, so anisotropization in fact occurs due to the hydrogen desorption, thereby providing a rare earth magnet powder which is excellent in coercivity and anisotropy.

In the present invention, by adding to the aforementioned rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a mixed powder; heating the mixed powder further; and then carrying out hydrogen absorption-decomposition by heating and holding the mixed powder at a predetermined temperature in a range of 500 to 1,000° C. in a hydrogen gas atmosphere with a pressure of 10 to 1,000 kPa, the raw material is induced to absorb hydrogen, thereby promoting a phase transformation and causing decomposition to occur. A Dy hydride powder, a Tb hydride powder, or a Dy—Tb binary alloy hydride powder, which is added to the rare earth magnet alloy raw material powder so as to produce the mixed powder, is restricted to have an average particle diameter in a range of 0.1 to 50 μm for the following reasons. When a Dy hydride powder, a Tb hydride powder, or a Dy—Tb binary alloy hydride powder has an average particle diameter of less than 0.1 μm, intense oxidation occurs, thereby making the powder very difficult to handle. On the other hand, when a Dy hydride powder, a Tb hydride powder, or a Dy—Tb binary alloy hydride powder has an average particle diameter of more than 50 μm, a phase of Dy, Tb, or a Dy—Tb binary alloy, or a compound phase having an excess of these elements segregates in the rare earth magnet powder, so it is impossible to diffuse uniformly. Therefore, the average particle diameter of these hydride powders has been set at 0.1 to 50 μm (more preferably 1 to 10 μm).

Also, the addition amount of a Dy hydride powder, a Tb hydride powder, or a Dy—Tb binary alloy hydride powder is restricted to be 0.01 to 5 mol % for the following reasons. At less than 0.01 mol %, a coercivity-improving effect cannot be obtained sufficiently. On the other hand, the addition of more than 5 mol % lowers the anisotropy, so sufficient magnetic properties cannot be obtained. Therefore, the addition amount of a Dy hydride powder, a Tb hydride powder, or a Dy—Tb binary alloy hydride powder was set at 0.01 to 5 mol % (more preferably 0.3 to 3 mol %).

The conditions under which the temperature is raised, or raised and held, from room temperature to a temperature below 500° C. in a hydrogen gas atmosphere with a pressure of 10 to 1,000 kPa during the hydrogen absorption treatment are already known. Likewise, the conditions under which the mixed powder is held at a predetermined temperature in a range of 500 to 1,000° C. in a hydrogen gas atmosphere with a pressure of 10 to 1,000 kPa during the subsequent hydrogen absorption-decomposition treatment are also already known. Because neither are particularly novel conditions, an explanation of the reasons for these limits is omitted here.

Following such hydrogen absorption-decomposition, intermediate heat treatment is carried out if necessary. This intermediate heat treatment is a step that accelerates anisotropization at a suitable speed by using an inert gas flow to change the atmosphere to an inert gas atmosphere. This intermediate heat treatment is carried out under conditions of holding the powder at a predetermined temperature in a range of 500 to 1,000° C. in an inert gas atmosphere with a pressure of 10 to 1,000 kPa. When an inert gas atmosphere pressure during the intermediate heat treatment is less than 10 kPa, anisotropization is unfavorably too rapid, causing a decrease of coercivity. On the other hand, when an inert gas atmosphere pressure during the intermediate heat treatment is more than 1,000 kPa, anisotropization substantially does not proceed, causing an unfavorable decrease of remanence.

Following the optional intermediate heat treatment, heat treatment in depressurized hydrogen is carried out if necessary. This heat treatment in depressurized hydrogen is a step in which the mixed powder subjected to hydrogen absorption-decomposition is held in a hydrogen atmosphere with an absolute pressure of at least 0.65 but less than 10 kPa (preferably 2 to 8 kPa) or in a mixed hydrogen/inert gas atmosphere with a hydrogen partial pressure of at least 0.65 but less than 10 kPa (preferably 2 to 8 kPa) so as to heat-treat the mixed powder with some hydrogen remaining therein. By carrying out this heat treatment in depressurized hydrogen, coercivity and remanence can be further improved.

After carrying out the optional intermediate heat treatment and the heat treatment in depressurized hydrogen, hydrogen desorption is carried out. Hydrogen desorption is a treatment holding the mixed powder in a vacuum atmosphere with an ultimate pressure of 0.13 kPa or below so as to forcibly release sufficient hydrogen from the mixed powder, thereby further promoting a phase transformation. The mixed powder is held in a vacuum atmosphere with an ultimate pressure of 0.13 kPa or less because sufficient hydrogen desorption is not carried out at an ultimate pressure exceeding 0.13 kPa.

In cooling carried out following the hydrogen desorption, the mixed powder is cooled to room temperature by flowing inert gas (Ar gas). Cooling is followed by pulverizing so as to produce a rare earth magnet powder. The rare earth magnet powder thus obtained by pulverizing has very low residual internal stress, and so does not require heat treatment. By binding the rare earth magnet powder obtained by the production method of the invention, which is further excellent in magnetic anisotropy and thermal stability, with an organic binder or metal binder, a rare earth magnet which is excellent in magnetic anisotropy and thermal stability can be produced. Alternatively, by molding this rare earth magnet powder, a green compact can be produced, and by processing the green compact with hot pressing or hot isostatic pressing at a temperature of 600 to 900° C., a rare earth magnet which is excellent in magnetic anisotropy and thermal stability can be produced.

(C) Reasons for Restricting Production Conditions in the Methods of Producing a Rare Earth Magnet Powder which is Excellent in Magnetic Anisotropy and Thermal Stability Described in Any One of the Aforementioned (12) to (16):

The hydrogen-absorbing rare earth magnet alloy raw material powder is produced by subjecting the rare earth magnet alloy raw material to the hydrogen absorption by heating the rare earth magnet alloy raw material from room temperature to a predetermined temperature below 500° C., or heating and holding at a predetermined temperature below 500° C. (for example, 100° C.), in a hydrogen gas atmosphere with a pressure of 10 to 1,000 kPa so as to induce the rare earth magnet alloy raw material to absorb hydrogen. This hydrogen absorption of heating the rare earth magnet alloy raw material from room temperature to a predetermined temperature below 500° C., or heating and holding at a predetermined temperature below 500° C. (for example, 100° C.), in a hydrogen gas atmosphere with a pressure of 10 to 1,000 kPa is a treatment that is carried out conventionally. In the present invention, the reasons for producing a hydrogen-absorbing rare earth magnet alloy raw material powder by milling this rare earth magnet alloy raw material subjected to the hydrogen absorption are the following.

- A bulk rare earth magnet alloy raw material subjected to the hydrogen absorption is easy to mill.
- The material is easier to mill than when milling is carried out in another step where the material is held at a high temperature because the hydrogen absorption is carried out at a relatively low temperature below 500° C.
- A sufficiently fine rare earth magnet powder can be obtained merely by pulverization in a final milling step because the bulk rare earth magnet alloy raw material is subjected to the hydrogen absorption, then milled beforehand to about the same average particle diameter as the rare earth magnet powder. Therefore, oxidation of the obtained rare earth magnet powder very rarely occurs and internal stresses very rarely build up, thereby further improving the magnetic anisotropy.
- When HDDR treatment is carried out following hydrogen pulverization, the surface unevenness of the magnet powder decreases, resulting in a smooth surface, and the specific surface area decreases, thereby improving thermal stability.

In the production of the hydrogen-absorbing rare earth magnet alloy raw material, the reason for milling the rare earth magnet alloy raw material to an average powder particle diameter of 10 to 1,000 μm (more preferably 50 to 400 μm) following the hydrogen absorption is as follows. Bulk rare earth magnet alloy raw material subjected to the hydrogen absorption is relatively resistant to oxidation, but when fine milling to an average particle diameter below 10 μm is attempted, the very small diameter makes oxidation inevitable during milling, and such oxidation has the undesirable effect of lowering the coercivity of the rare earth magnet powder ultimately obtained. On the other hand, when an average particle diameter is longer than 1,000 μm, the axis of easy magnetization in each powder particle of the rare earth magnet powder ultimately obtained by pulverizing is difficult to align, so the magnetic anisotropy is lowered unfavorably. The hydrogen-absorbing rare earth magnet alloy raw material powder has substantially the same average particle diameter as the rare earth magnet powder ultimately obtained.

A rare earth magnet powder which is excellent in magnetic anisotropy and thermal stability can be obtained by adding to the aforementioned hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; carrying out hydrogen absorption-decomposition by heating and holding the hydrogen-containing raw material mixed powder at a temperature in a range of 500 to 1,000° C. in a hydrogen gas atmosphere with a pressure of 10 to 1,000 kPa so as to induce the hydrogen-containing raw material mixed powder to absorb further hydrogen and to be decomposed; and then carrying out hydrogen desorption by holding the hydrogen-containing raw material mixed powder at a temperature in a range of 500 to 1,000° C. in a vacuum atmosphere with an ultimate pressure of 0.13 kPa or below so as to forcibly release hydrogen and promote a phase transformation, followed by cooling and pulverizing.

When the hydrogen-containing mixed powder, which is obtained by adding to the hydrogen-absorbing rare earth magnet alloy raw material powder a Dy hydride powder, a Tb hydride powder or a Dy—Tb binary alloy hydride powder, followed by mixing, is subjected to hydrogen absorption-decomposition followed by hydrogen desorption, a rare earth magnet powder which is further excellent in magnetic anisotropy and thermal stability is obtained. The reasons are as follows.

It has been found from recent research that the reactions at the stage of hydrogen absorption-decomposition are important in the case of anisotropizing a rare earth magnet powder by carrying out the HDDR treatment. On the other hand, when a large amount of one or both of Dy and Tb is added to the rare earth magnet alloy in an attempt to increase the coercivity for the purpose of the thermal stability, as described in Patent document (Japanese Patent Application, First Publication No. 1997-165601), the anisotropy decreases, and a sufficient energy product cannot be obtained. This is probably because the inclusion of a large amount of one or both of Dy and Tb in the rare earth magnet alloy affects the reactions of the aforementioned hydrogen absorption-decomposition; therefore, the state formed by the hydrogen absorption-decomposition reactions does not satisfy the conditions for anisotropization.

However, when the hydrogen-containing raw material mixed powder, which is produced by adding a Dy hydride powder, a Tb hydride powder, or a Dy—Tb binary alloy hydride powder to the rare earth magnet alloy raw material powder subjected to the hydrogen absorption, followed by mixing, is subjected to the hydrogen absorption-decomposition as in the present invention, the decomposition reactions at that time proceed toward the formation of rare earth element hydrides formed from the rare earth magnet alloy and the decomposition of the residue into the phase primarily including Fe or (Fe,Co), and $Fe_2B$. Because a Dy hydride powder, a Tb hydride powder, or a Dy—Tb binary alloy hydride powder, which is a rare earth element, does not take part in these decomposition reactions, only the rare earth magnet alloy raw material powder is decomposed. Therefore, unlike when a large amount of one or both of Dy and Tb is added to a rare earth magnet alloy, the state formed by the hydrogen absorption-decomposition reactions does not fail to satisfy the conditions for anisotropization.

Subsequently, when hydrogen desorption is carried out from the aforementioned state, the phase primarily including R hydrides, Fe or (Fe,Co), and $Fe_2B$, which have been decomposed in the rare earth magnet alloy raw material powder, reacts so as to form a $R_2Fe_{14}B$-based phase. In addition, a Dy hydride powder, a Tb hydride powder, or a Dy—Tb binary alloy hydride powder also releases hydrogen, so one or both atoms of Dy and Tb diffuse in the entire surface of the rare earth magnet alloy raw material powder, and then diffuse into the interior of the rare earth magnet alloy raw material powder. Therefore, the $R_2Fe_{14}B$-based phase that is ultimately formed has a higher content of one or both of Dy and Tb than the original rare earth magnet alloy raw material powder, and the content of one or both of Dy and Tb near the surface in each powder particle is higher than the content near the center therein. As a result, coercivity is improved, and the temperature coefficient of coercivity decreases, thereby improving the thermal stability. Meanwhile, the following reason can also be believed. The conditions for anisotropization are satisfied at the stage of the hydrogen absorption-decomposition reactions, so anisotropization in fact occurs due to the hydrogen desorption, thereby providing a rare earth magnet powder which is excellent in coercivity and anisotropy.

In the present invention, by adding to the aforementioned hydrogen-absorbing rare earth magnet alloy raw material powder a Dy hydride powder, a Tb hydride powder, or a Dy—Tb binary alloy hydride powder, each of which has an average powder particle diameter of 0.1 to 50 μm, at 0.01 to 5 mol %, followed by mixing so as to produce a hydrogen-containing raw material mixed powder; heating the hydrogen-containing raw material mixed powder further; and then carrying out hydrogen absorption-decomposition by heating and holding the mixed powder at a predetermined temperature in a range of 500 to 1,000° C. in a hydrogen gas atmosphere with a pressure of 10 to 1,000 kPa, the raw material is induced to absorb hydrogen, thereby promoting a phase transformation and causing decomposition to occur.

A Dy hydride powder, a Tb hydride powder, or a Dy—Tb binary alloy hydride powder, which is added to the hydrogen-absorbing rare earth magnet alloy raw material powder so as to produce the hydrogen-containing raw material mixed powder, is restricted to have an average particle diameter in a range of 0.1 to 50 μm for the following reasons. When a Dy hydride powder, a Tb hydride powder, or a Dy—Tb binary alloy hydride powder has an average particle diameter of less than 0.1 μm, intense oxidation occurs, thereby making the powder very difficult to handle. On the other hand, when a Dy hydride powder, a Tb hydride powder, or a Dy—Tb binary alloy hydride powder has an average particle diameter of more than 50 μm, a phase of Dy, Tb, or a Dy—Tb binary alloy, or a compound phase having an excess of these elements segregates in the rare earth magnet powder, so it is impossible to diffuse uniformly. Therefore, the average particle diameter of these hydride powders has been set at 0.1 to 50 μm (more preferably 1 to 10 μm). Also, the addition amount of a Dy hydride powder, a Tb hydride powder, or a Dy—Tb binary alloy hydride powder is restricted to be 0.01 to 5 mol % for the following reasons. At less than 0.1 mol %, a coercivity-improving effect cannot be obtained sufficiently. On the other hand, the addition of more than 5 mol % lowers the anisotropy, so sufficient magnetic properties cannot be obtained. Therefore, the addition amount of a Dy hydride powder, a Tb hydride powder, or a Dy—Tb binary alloy hydride powder was set at 0.01 to 5 mol % (more preferably 0.3 to 3 mol %).

The conditions under which the hydrogen-containing raw material mixed powder is held at a predetermined temperature in a range of 500 to 1,000° C. in a hydrogen gas atmosphere with a pressure of 10 to 1,000 kPa during the subsequent hydrogen absorption-decomposition treatment are already known. Because they are not particularly novel conditions, an explanation of the reasons for these limits is omitted here.

Following such hydrogen absorption-decomposition, intermediate heat treatment is carried out if necessary. This intermediate heat treatment is a step that accelerates anisotropization at a suitable speed by using an inert gas flow to change the atmosphere to an inert gas atmosphere. This intermediate heat treatment is carried out under conditions of holding the powder at a predetermined temperature in a range of 500 to 1,000° C. in an inert gas atmosphere having a pressure of 10 to 1,000 kPa. When an inert gas atmosphere pressure during the intermediate heat treatment is less than 10 kPa, anisotropization is unfavorably too rapid, causing a decrease of the coercivity. On the other hand, at more than 1,000 kPa, anisotropization substantially does not proceed, causing an unfavorable decrease of the remanence.

Following the optional intermediate heat treatment, heat treatment in depressurized hydrogen is carried out if necessary. This heat treatment in depressurized hydrogen is a step in which the hydrogen-containing raw material mixed powder subjected to hydrogen absorption-decomposition is held in a hydrogen atmosphere with an absolute pressure of at least 0.65 but less than 10 kPa (preferably 2 to 8 kPa) or in a mixed hydrogen/inert gas atmosphere with a hydrogen partial pressure of at least 0.65 but less than 10 kPa (preferably 2 to 8 kPa) so as to heat-treat the hydrogen-containing raw material mixed powder with some hydrogen remaining therein. By carrying out this heat treatment in depressurized hydrogen, coercivity and remanence can be further improved.

After carrying out the optional intermediate heat treatment and heat treatment in depressurized hydrogen, hydrogen desorption is carried out. Hydrogen desorption is a treatment holding the hydrogen-containing raw material mixed powder in a vacuum atmosphere with an ultimate pressure of 0.13 kPa or below so as to forcibly release sufficient hydrogen from the hydrogen-containing raw material mixed powder, thereby further promoting a phase transformation. The hydrogen-containing raw material mixed powder is held in a vacuum atmosphere with an ultimate pressure of 0.13 kPa or less because sufficient hydrogen desorption is not carried out at an ultimate pressure exceeding 0.13 kPa.

In cooling carried out following the hydrogen desorption, the hydrogen-containing raw material mixed powder is cooled to room temperature by flowing inert gas (Ar gas). Cooling is followed by pulverizing so as to produce a rare earth magnet powder. The rare earth magnet powder thus obtained by pulverizing has very low residual internal stress, and so does not require heat treatment. By binding the rare earth magnet powder obtained by the production method of the invention, which is further excellent in magnetic anisotropy and thermal stability, with an organic binder or metal binder, a rare earth magnet which is excellent in magnetic anisotropy and thermal stability can be produced. Alternatively, by molding this rare earth magnet powder, a green compact can be produced, and by processing the green compact with hot pressing or hot isostatic pressing at a temperature of 600 to 900° C., a rare earth magnet which is excellent in magnetic anisotropy and thermal stability can be produced.

The rare earth magnet alloy raw material, which is used in the method of producing a rare earth magnet powder which is excellent in magnetic anisotropy and thermal stability described in any one of the aforementioned (7) to (16), may or may not include one or both of Dy and Tb. Therefore, the rare earth magnet alloy raw material, which is used in the method of producing a rare earth magnet powder which is excellent in magnetic anisotropy and thermal stability of the present invention, has the same chemical composition as the rare earth magnet alloy raw materials used to produce the conventional magnetically anisotropic HDDR magnet powders described in Patent documents 1 and 2. More specifically, when one, or two or more rare earth elements which includes Y, and may or may not include one or both of Dy and Tb is referred to as R', the rare earth magnet alloy raw material in the present invention includes:

a chemical composition including R': 10 to 20% and B: 3 to 20%, with the balance including Fe and inevitable impurities;

a chemical composition including R': 10 to 20%, B: 3 to 20%, and M: 0.001 to 5%, with the balance including Fe and inevitable impurities;

a chemical composition including R': 10 to 20%, Co: 0.1 to 50%, and B: 3 to 20%, with the balance including Fe and inevitable impurities; or a chemical composition including R': 10 to 20%, Co: 0.1 to 50%, B: 3 to 20%, and M: 0.001 to 5%, with the balance including Fe and inevitable impurities.

EXAMPLES

Hereinafter, examples of the present invention are described, while the present invention is not restricted to these examples.

Ingots a to o of rare earth magnet alloy raw materials having the chemical compositions shown in Table 1 were produced by melting the respective raw materials in a high-frequency vacuum melting furnace, casting the obtained melts, and carrying out homogenizing treatment by holding the ingots at 1,100° C. for 24 hours in an Ar gas atmosphere. These ingots a to o were crushed in an Ar gas atmosphere so as to produce blocks up to 10 mm in size.

TABLE 1

| Type | | Chemical composition (in atom %) (wherein balance: Fe) |
|---|---|---|
| Ingot | a | Nd: 12.3%, Co: 17.0%, B: 6.5%, Zr: 0.1%, Ga: 0.3% |
| | b | Nd: 11.6%, Dy: 1.8%, Pr: 0.2%; B: 6.1% |
| | c | Nd: 11.5%, Dy: 0.8%, Pr: 0.2%, Co: 7.0%, B: 6.5%, Zr: 0.1%, Ti: 0.3% |
| | d | Nd: 12.5%, Pr: 0.5%, Co: 18.0%, B: 6.5%, Zr: 0.1%, Ga: 0.3% |
| | e | Nd: 11.9%, La: 0.4%, Co: 14.7%, B: 6.8%, Hf: 0.1%, Si: 0.3%, W: 0.5% |
| | f | Nd: 12.0%, Dy: 2.0%, B: 6.5%, Hf: 0.1% |
| | g | Nd: 12.3%, Dy: 1.8%, Co: 16.9%, B: 6.6%, Zr: 0.2%, Ga: 0.3%, Al: 0.5% |
| | h | Nd: 11.0%, Pr: 3.0%, Co: 20.0%, B: 6.5%, Si: 0.1%, Ga: 0.3% |
| | I | Nd: 9.0%, Ce: 4.0%, Co: 10.0%, B: 6.5%, Nb: 0.4% |
| | j | Nd: 8.0%, Dy: 5.0%, Co: 5.0%, B: 6.5%, Zr: 0.1%, Ta: 0.4% |
| | k | Nd: 11.4%, Dy: 2.1%, Co: 15.0%, B: 7.0% |

TABLE 1-continued

| Type | | Chemical composition (in atom %) (wherein balance: Fe) |
|---|---|---|
| | l | Nd: 12.2%, Tb: 1.2%, Co: 12.0%, B: 7.5%, Ge: 0.3%, Cr: 0.1% |
| | m | Nd: 11.3%, Pr: 2.0%, Gd: 1.0%, B: 6.8%, V: 0.3%, Cu: 0.1% |
| | n | Nd: 12.4%, Dy: 1.0%, Co: 8.0%, B: 6.5%, Ni: 0.1%, Mo: 0.3% |
| | o | Nd: 11.2%, Pr: 2.0%, Co: 11.2%, B: 6.5%, Zr: 0.1%, Ga: 0.3%, C: 0.2% |

Example 1

The present invention's methods 1 to 5 were carried out as follows. Blocks obtained from ingots a to e in Table 1 were milled in an Ar gas atmosphere to the average particle diameters shown in Table 2 so as to produce rare earth magnet alloy raw material powders. To these rare earth magnet alloy raw material powders, a Dy hydride powder, a Tb hydride powder, or a Dy—Tb binary alloy hydride powder, each of which has an average particle diameter of 5 μm was added thereto at the amount shown in Table 2, and then mixed therewith so as to produce mixed powders. The respective mixed powders were then subjected to, in order, hydrogen absorption under the conditions shown in Table 2; hydrogen absorption-decomposition under the conditions shown in Table 2; if necessary, intermediate heat treatment under the conditions shown in Table 2; if necessary, heat treatment in depressurized hydrogen under the conditions shown in Table 2; hydrogen desorption under the conditions shown in Table 3; forcibly cooling to room temperature with Ar gas; and then pulverizing to 300 μm or below, thereby producing rare earth magnet powders.

Conventional Example 1

Conventional methods 1 to 5 were carried out as follows. Blocks obtained from ingots a to e in Table 1 were subjected to hydrogen absorption under the same conditions as in Example 1 and shown in Table 2 without milling the blocks nor adding a hydride powder so as to produce a mixed powder, and then were subjected to, in order, hydrogen absorption-decomposition under the same conditions as in Example 1 and shown in Table 2; if necessary, heat treatment in depressurized hydrogen under the conditions shown in Table 2; forcibly cooling to room temperature in Ar gas; and then milling treatment to the average particle diameter shown in Table 3 so as to produce rare earth magnet raw material hydride powders. Then, to these rare earth magnet raw material hydride powders, a Dy hydride powder, a Tb hydride powder, or a Dy—Tb binary alloy hydride powder, each of which has an average particle diameter of 5 μm, was added at the amount shown in Table 3 and then mixed therewith so as to produce hydrogen-containing raw material mixed powders. Each of these hydrogen-containing raw material mixed powders was subjected to diffusion heat-treating including heating in a vacuum followed by holding under the conditions shown in Table 3; hydrogen desorption under the conditions shown in Table 3; forcibly cooling to room temperature with Ar gas; and then pulverizing to 300 μm or below, thereby producing rare earth magnet powders.

Each of the rare earth magnet powders obtained by using the present invention's methods 1 to 5 and the conventional methods 1 to 5 was embedded in a phenolic resin and polished to a mirror surface, and the detected intensities of near-center and near-surface Dy and/or Tb and the intensity ratio thereof were measured by analysis with an electron probe microanalyzer (hereinafter abbreviated as "EPMA"; model JXA-8800RL manufactured by JEOL Ltd.) which is a type of wavelength dispersive X-ray spectrometer, thereby determining the values of the depth of the Dy—Tb rich layer from the surface and of the surface coverage by the Dy—Tb rich layer. Those results are given in Table 4.

In addition, to each of the rare earth magnet powders obtained in the present invention's methods 1 to 5 and the conventional methods 1 to 5, an epoxy resin was added at 3 wt % and then mixed therewith, and each of the mixtures was compression-molded in a magnetic field of 1.6 MA/m so as to produce a green compact. The green compact was hardened in an oven at 150° C. for 2 hours so as to produce a bonded magnet having a density of 6.0 to 6.1 g/cm$^3$. The magnetic properties of the obtained bonded magnet are shown in Table 5. Also, the temperature coefficient of coercivity $\alpha_{iHc}$ for each magnet was determined from the result of the magnetic properties measured at 150° C., and those values are shown in Table 5. Herein, the temperature coefficient of coercivity $\alpha_{iHc}$ is the value obtained as follows: $\alpha_{iHc}$ (%/° C.)=[{(coercivity at 150° C.−coercivity at room temperature (20° C.))/coercivity at room temperature (20° C.)}/(150−20)]×100.

In addition, the rare earth magnet powders obtained by using the present invention's method 1 to 5 and the conventional methods 1 to 5 were compression-molded in a magnetic field to produce anisotropic green compacts. These anisotropic green compacts were set in a hot-pressing apparatus, and hot pressing was carried out under the following conditions: pressing in parallel to the magnetic aligned direction; an Ar gas atmosphere; a temperature of 750° C.; a pressure of 58.8 MPa; and holding time of 1 minute. The hot pressing was following by quenching so as to produce hot-pressed magnets having a density of 7.5 to 7.7 g/cm$^3$. The magnetic properties of the obtained hot-pressed magnets are shown in Table 5. Also, the temperature coefficient of coercivity $\alpha_{iHc}$ was determined from the result of the magnetic properties measured at 150° C., and those values are shown in Table 5.

Also, to each of the rare earth magnet powders obtained in the present invention's methods 1 to 5 and the conventional methods 1 to 5, an epoxy resin was added at 3 wt % and then mixed therewith, and each of the mixtures was compression-molded while applying a magnetic field of 1.6 MA/m in a compacting direction so as to produce a green compact with a cylindrical shape having a diameter of 10 mm and a height of 7 mm. Subsequently, the obtained cylindrical green compact was hardened in an oven at 150° C. for 2 hours so as to produce a cylindrical bonded magnet having a density of 6.0 to 6.1 g/cm$^3$. The obtained bonded magnet was magnetized in pulsed magnetic field of a 70 kOe, and then held for 1,000 hours in an oven maintained at 100° C., and the thermal demagnetizing rates after 3 hours, 100 hours, and 1,000 hours were measured. Those results are shown in Table 5, and the thermal stability was evaluated.

Herein, a "thermal demagnetizing rate" refers to the value obtained as follows: thermal demagnetizing rate (%)={(total magnetic flux after exposure for a predetermined hours−total magnetic flux before exposure)/total magnetic flux before exposure}×100. Also, a "thermal demagnetizing rate" can be referred to as an "irreversible flux loss".

TABLE 2

| Type | | Ingot in Table 1 | Average particle diameter of rare earth magent raw material powder obtained by milling ingot in Table 1 in Ar atmosphere (μm) | Mixed powder Amount of hydride added to rare earth magnet raw material powder (mol %) Dy hydride | Tb hydride | Dy—Tb alloy hydride | Hydrogen absorption | Hydrogen absorption-decomposition | Intermediate heat treatment Ar pressure (kPa) | Holding temp. (° C.) | Holding time (min) | Heat treatment in depressurized hydrogen Hydrogen pressure (kPa) | Holding temp. (° C.) | Holding time (min) |
|---|---|---|---|---|---|---|---|---|---|---|---|---|---|---|
| Invention's method | 1 | a | 300 | 0.9 | — | — | Hydrogen partial pressure: 200 kPa Holding temp.: 150° C. Holding time: 20 min | Hydrogen partial pressure: 200 kPa Holding temp.: 820° C. Holding time: 120 min | 200 | 820 | 5 | 3.9 | 820 | 120 |
| Conventional method | | | — | | — | | | | — | — | — | | | |
| Invention's method | 2 | b | 300 | — | 0.9 | — | | | | — | | 3.9 | 820 | 120 |
| Conventional method | | | — | | — | | | | | | | | | |
| Invention's method | 3 | c | 300 | — | — | 0.9 | | | 200 | 820 | 5 | | — | |
| Conventional method | | | — | | — | | | | — | — | — | 3.9 | 820 | 120 |
| Invention's method | 4 | d | 300 | 0.45 | 0.45 | — | | | | — | | | — | |
| Conventional method | | | — | | — | | | | | | | 3.9 | 820 | 120 |
| Invention's method | 5 | e | 300 | 0.3 | 0.3 | 0.3 | | | 200 | 820 | 5 | 3.9 | 820 | 120 |
| Conventional method | | | — | | — | | | | — | — | — | | | |

TABLE 3

| Type | | Remarks | Average particle diameter of rare earth magnet raw material hydride powder obtained by heat-treating ingot in Table 1 in depressurized hydrogen, then milling (μm) | Hydrogen-containing raw material mixed powder Amount of Dy/Tb hydride added to rare earth magnet raw material hydride powder (mol %) | | | Diffusion heat-treatment | | | Hydrogen desorption | | |
|---|---|---|---|---|---|---|---|---|---|---|---|---|
| | | | | Dy hydride | Tb hydride | Dy—Tb alloy hydride | Pressure (kPa) | Holding temp. (° C.) | Holding time (min) | Ultimate pressure (kPa) | Holding temp. (° C.) | Holding time (min) |
| Invention's method | 1 | Continued from Table 2 | — | | — | | | — | | 0.013 | 820 | 10 |
| Conventional method | | | 300 | 0.9 | — | — | $1 \times 10^{-4}$ | 820 | 30 | $1 \times 10^{-4}$ | | 30 |
| Invention's method | 2 | | — | | — | | | — | | 0.013 | 820 | 9 |
| Conventional method | | | 300 | — | 0.9 | — | $1 \times 10^{-4}$ | 820 | 30 | $1 \times 10^{-4}$ | | 30 |
| Invention's method | 3 | | — | | — | | | — | | 0.013 | 820 | 10 |
| Conventional method | | | 300 | — | — | 0.9 | $1 \times 10^{-4}$ | 820 | 30 | $1 \times 10^{-4}$ | | 30 |
| Invention's method | 4 | | — | | — | | | — | | 0.013 | 820 | 8 |
| Conventional method | | | 300 | 0.45 | 0.45 | — | $1 \times 10^{-4}$ | 820 | 30 | $1 \times 10^{-4}$ | | 30 |
| Invention's method | 5 | | — | | — | | | — | | 0.013 | 820 | 11 |
| Conventional method | | | 300 | 0.3 | 0.3 | 0.3 | $1 \times 10^{-4}$ | 820 | 30 | $1 \times 10^{-4}$ | | 30 |

TABLE 4

| Type | | Remarks | Rare earth magnet powder | | | | |
|---|---|---|---|---|---|---|---|
| | | | EPMA detected intensity | | | Thickness | |
| | | | Peak value near surface (counts) | Peak value near center (counts) | Intensity ratio | of Dy—Tb rich layer (μm) | Coverage (%) |
| Invention's method | 1 | Continued from Table 3 | 1410 | 811 | 1.74 | 4.1 | 95 |
| Conventional method | | | 1180 | 1176 | 1.00 | — | 0 |
| Invention's method | 2 | | 3929 | 1854 | 2.12 | 7.8 | 90 |
| Conventional method | | | 2160 | 2182 | 0.99 | — | 0 |
| Invention's method | 3 | | 2677 | 1394 | 1.92 | 6.1 | 90 |
| Conventional method | | | 1685 | 1668 | 1.01 | — | 0 |
| Invention's method | 4 | | 1650 | 887 | 1.86 | 5.9 | 100 |
| Conventional method | | | 1257 | 1252 | 1.00 | — | 0 |
| Invention's method | 5 | | 1562 | 924 | 1.69 | 5.4 | 95 |
| Conventional method | | | 1315 | 1289 | 1.02 | — | 0 |

TABLE 5

| Type | | Bonded magnet Br (T) | iHc (MA/m) | BHmax (KJ/m³) | $\alpha_{iHc}$ (%/° C.) | Hot-pressed magnet Br (T) | iHc (MA/m) | BHmax (KJ/m³) | $\alpha_{iHc}$ (%/° C.) | Thermal demagnetizing rate for bonded magnet after being held for time indicated below in 100° C. oven (%) 3 hours | 100 hours | 1,000 hours |
|---|---|---|---|---|---|---|---|---|---|---|---|---|
| Invention's method | 1 | 0.99 | 1.16 | 188 | −0.37 | 1.26 | 1.14 | 283 | −0.40 | −7.3 | −8.3 | −9.9 |
| Conventional method | | 0.98 | 1.05 | 179 | −0.45 | 1.24 | 1.04 | 274 | −0.48 | −8.9 | −11.9 | −17.6 |
| Invention's method | 2 | 0.94 | 1.67 | 158 | −0.35 | 1.18 | 1.66 | 250 | −0.37 | −5.1 | −5.8 | −6.8 |
| Conventional method | | 0.92 | 1.53 | 150 | −0.43 | 1.17 | 1.51 | 242 | −0.46 | −6.1 | −8.2 | −12.1 |
| Invention's method | 3 | 0.95 | 1.69 | 171 | −0.38 | 1.21 | 1.67 | 260 | −0.41 | −5.0 | −5.7 | −6.8 |
| Conventional method | | 0.94 | 1.52 | 163 | −0.44 | 1.19 | 1.55 | 252 | −0.47 | −6.0 | −8.0 | −11.8 |
| Invention's method | 4 | 0.98 | 1.32 | 185 | −0.37 | 1.24 | 1.31 | 271 | −0.40 | −6.4 | −7.3 | −8.7 |
| Conventional method | | 0.96 | 1.19 | 176 | −0.45 | 1.22 | 1.18 | 263 | −0.48 | −7.8 | −10.5 | −15.5 |
| Invention's method | 5 | 0.94 | 1.28 | 172 | −0.38 | 1.20 | 1.27 | 255 | −0.41 | −6.6 | −7.5 | −8.9 |
| Conventional method | | 0.93 | 1.15 | 164 | −0.46 | 1.18 | 1.14 | 247 | −0.49 | −8.1 | −10.8 | −16.0 |

On the basis of the results shown in Tables 1 to 5, the magnetic properties of the bonded magnets and the hot-pressed magnets produced by using the rare earth magnet powders produced by the present invention's methods 1 to 5, in which a mixed powder was produced by milling a block in an Ar gas atmosphere followed by adding a hydride powder thereto, showed improvements in both coercivity and remanence when compared with the magnetic properties of bonded magnets and hot-pressed magnets produced by using the rare earth magnet powders produced by the conventional methods 1 to 5 in which milling was not carried out and a hydride was not added. Moreover, the temperature coefficient of the coercivity and the thermal demagnetizing rate were both small, indicating that each of the magnets obtained by the present invention's methods also had an excellent thermal stability.

The methods, which determine the depth of the Dy—Tb rich layer from the surface and the surface coverage of the layer by measuring the detected intensities and the ratio thereof in the present invention, are described in detail below using the rare earth magnet powder obtained by the present invention's method 1.

Figure 2:
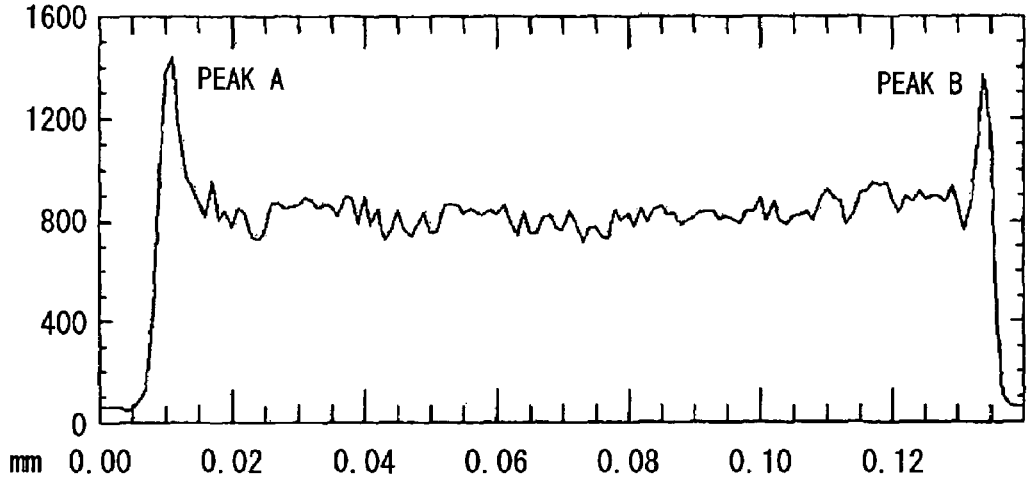
FIG. 2 is a line analysis graph obtained by using an electron probe microanalyzer (EPMA), which shows the distribution of Dy on line A-B in FIG. 1 of Dy contained in the anisotropic magnet powder produced by the present invention's method 1.

First, the rare earth magnet powder obtained by the present invention's method 1 was embedded in phenolic resin and polished to a mirror surface; then, the elemental distribution of Dy in an internal cross-section of the powder was examined with the EPMA. FIG. 1 shows an image of the elemental distribution of Dy taken at that time. Places having a greater number of bright points indicate a higher Dy content. The presence of numerous bright points near the peripheral edge of the cross-section indicates that the Dy content in a powder particle is higher near the surface than near the center. Therefore, a line analysis of the Dy on a straight line from point A to point B in FIG. 1 was carried out with the EPMA. Measurement at this time was carried out under the following conditions: an acceleration voltage of 15 kV; the minimum electron beam diameter; a dwell time of 1.0 sec/point; and measurement intervals of 1.0 μm, and using the Dy Lα emission (a wavelength of 0.1909 nm) that is a characteristic X-ray of Dy. The results are shown in FIG. 2. The horizontal axis of the graph represents the migration distance (mm) within the sample, and the vertical axis represents the detected intensity of the Dy Lα emission as an X-ray count. A Dy Lα emission of 800 counts or more is detected in the portion of the plot extending from the vicinity of 0.01 mm to the vicinity of 0.135 mm that corresponds to a powder particle. In particular, it is apparent that the peak near 0.01 mm (hereinafter referred to as "Peak A") having an intensity of 1440 counts and the peak near 0.135 mm (hereinafter referred to as "Peak B") having an intensity of 1380 counts are strong peaks at both ends, indicating that the Dy content in the powder particle is higher near the surface than near the center. The intensity near the center, which is calculated as the average intensity between 0.051 mm and 0.093 mm (a region which corresponds to ⅓ of the powder particle diameter), was 811 counts. Therefore, the intensity ratios of Peak A and Peak B relative to the near-center region were found to be respectively 1.78 and 1.70, and both values were substantially larger than 1.2. When similar line analyses were carried out ten times, each time at a different sample orientation, the detected intensities at 19 places near the surface were found to be at least 1.2 times the detected intensity near the center; therefore, the surface coverage by high Dy content regions was determined to be 95%.

Figure 3:
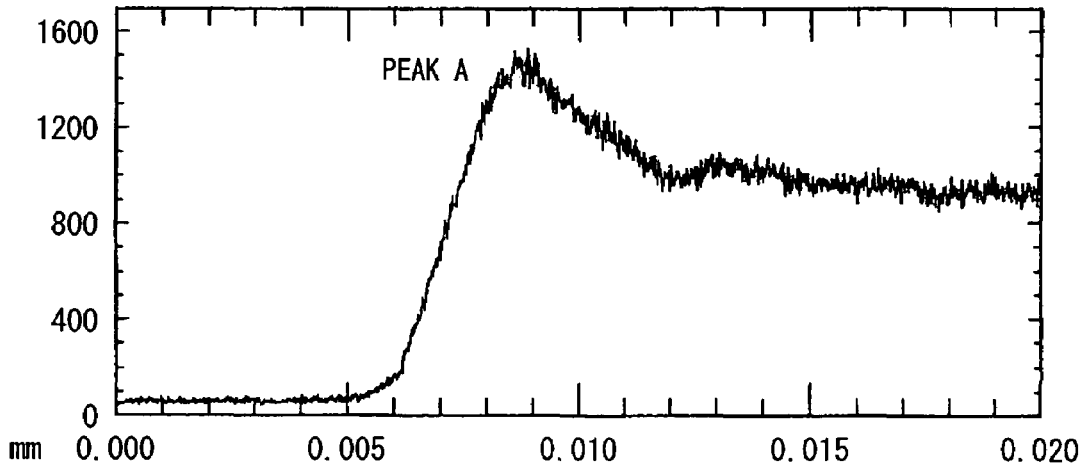
FIG. 3 is a line analysis graph obtained by scanning at fine intervals near peak A in FIG. 2, which shows the elemental distribution on the line of Dy contained in the anisotropic magnet powder produced by the present invention's method 1.
Figure 4:
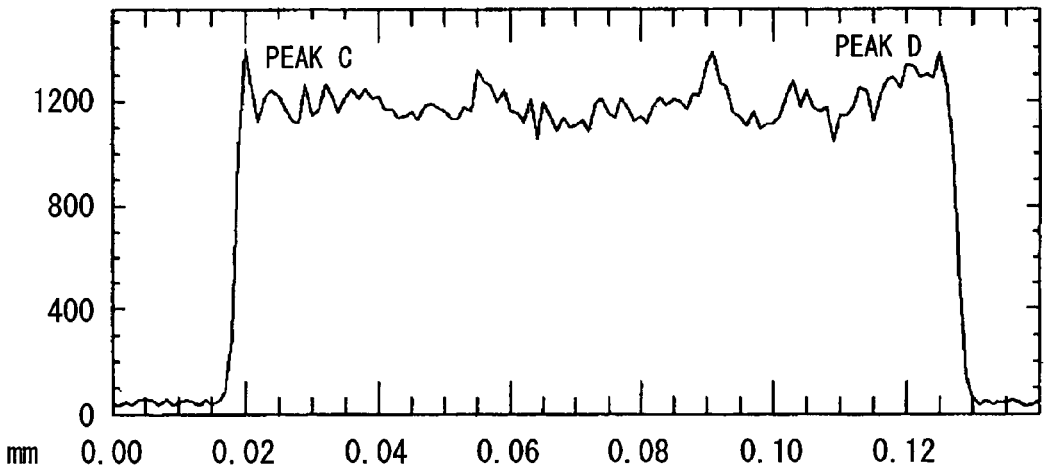
FIG. 4 is a line analysis graph obtained by using an electron probe microanalyzer (EPMA), which shows the elemental distribution of Dy contained in the anisotropic magnet powder produced by the conventional method 1.
Figure 5:
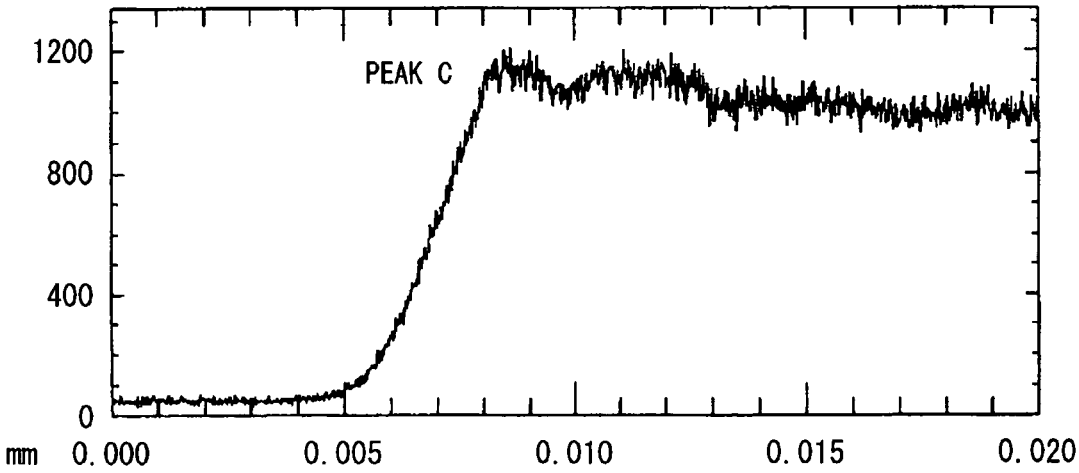
FIG. 5 is a line analysis graph obtained by scanning at fine intervals near peak C in FIG. 4, which shows the elemental distribution of Dy contained in the anisotropic magnet powder produced by the conventional method 1.

Next, line analysis centered on Peak A was carried out with a dwell time of 1.0 sec and at an as small measurement interval of 20 nm as possible. The results are shown in FIG. 3. The Peak A region was defined as the region where the intensity was at least 1.2 times (973 counts) the detected intensity near the center, the 1.2 times being thought to be of sufficient significance. Then, the Peak A region had a width of 4.1 μm. Analysis by the EPMA was similarly carried out on the magnet powder obtained by the conventional method 1. FIG. 4 shows the results of line analysis at 1.0 μm intervals. The average detected intensity of Dy Lα emission near the center was 1176 counts, and the intensity near the surface was 1360 counts in the vicinity of 0.02 mm (hereinafter referred to as "Peak C"), which was less than 1411 counts of 1.2 times the intensity near the center. FIG. 5 shows the results of line analysis at 20 nm intervals. When measured at 20 nm intervals, the intensity of Peak C was in fact 1180 counts which did not differ from the intensity near the center. Thus, it was found that the Dy content near the surface and the Dy content near the center did not have substantial difference.

Likewise, the detected intensities of Dy and Tb near the center and near the surface, the intensity ratio therebetween, the thickness of the Dy—Tb rich layer, and the surface coverage by the Dy—Tb rich layer were determined by analysis with the EPMA for rare earth magnet powders produced by the present invention's methods 2 to 5 and the conventional methods 2 to 5. These values were likewise determined also for rare earth magnet powders produced by the present invention's methods 6 to 30 and the conventional methods 6 to 30 in Examples 2 to 6 described below.

Example 2

The present invention's methods 6 to 10 were carried out as follows. Blocks obtained from ingots f to j in Table 1 were milled in an Ar gas atmosphere to the average particle diameters shown in Table 6 so as to produce rare earth magnet alloy raw material powders. To these rare earth magnet alloy raw material powders, a Dy hydride powder, a Tb hydride powder, or a Dy—Tb binary alloy hydride powder, each of which has an average particle diameter of 5 μm was added at the amount shown in Table 6, and then mixed therewith so as to produce mixed powders. The respective mixed powders were then subjected to, in order, hydrogen absorption under the conditions shown in Table 6; hydrogen absorption-decomposition under the conditions shown in Table 6; if necessary, intermediate heat treatment under the conditions shown in Table 7; if necessary, heat treatment in depressurized hydrogen under the conditions shown in Table 7; hydrogen desorption under the conditions shown in Table 8; forcibly cooling to room temperature with Ar gas; and then pulverizing to 300 μm or below, thereby producing rare earth magnet powders.

Conventional Example 2

Conventional methods 6 to 10 were carried out as follows. Blocks obtained from ingots f to j in Table 1 were subjected to hydrogen absorption under the same conditions as in Example 2 and shown in Table 6 without milling the blocks nor adding a hydride powder so as to produce a mixed powder, and then were subjected to, in order, hydrogen absorption-decomposition under the same conditions as in Example 2 and shown in Table 6; if necessary, heat treatment in depressurized hydrogen under the conditions shown in Table 7; forcibly cooling to room temperature in Ar gas; and then milling treatment to the average particle diameter shown in Table 8 so as to produce rare earth magnet raw material hydride powders. Then, to these rare earth magnet raw material hydride powders, a Dy hydride powder, a Tb hydride powder, or a Dy—Tb binary alloy hydride powder, each of which has an average particle diameter of 5 μm, was added at the amount shown in Table 8 and then mixed therewith so as to produce hydrogen-containing raw material mixed powders. Each of these hydrogen-containing raw material mixed powders was subjected to diffusion heat-treating including heating in a vacuum followed by holding under the conditions shown in Table 8; hydrogen desorption under the conditions shown in Table 8; forcibly cooling to room temperature with Ar gas; and then pulverizing to 300 μm or below, thereby producing rare earth magnet powders.

Each of the rare earth magnet powders obtained by using the present invention's methods 6 to 10 and the conventional methods 6 to 10 was embedded in a phenolic resin and polished to a mirror surface, and the detected intensities of near-center and near-surface Dy and/or Tb and the intensity ratio thereof were measured by analysis with the EPMA, thereby determining the values of the depth of the Dy—Tb rich layer from the surface and of the surface coverage by the Dy—Tb rich layer. Those results are given in Table 9.

In addition, to each of the rare earth magnet powders obtained in the present invention's methods 6 to 10 and the conventional methods 6 to 10, an epoxy resin was added at 3 wt % and then mixed therewith, and each of the mixtures was compression-molded in a magnetic field of 1.6 MA/m so as to produce a green compact. The green compact was hardened in an oven at 150° C. for 2 hours so as to produce a bonded magnet having a density of 6.0 to 6.1 g/cm$^3$. The magnetic properties of the obtained bonded magnet are shown in Table 10. Also, the temperature coefficient of coercivity $\alpha_{iHc}$ for each magnet was determined from the result of the magnetic properties measured at 150° C., and those values are shown in Table 10.

Also, to each of the rare earth magnet powders obtained in the present invention's methods 6 to 10 and the conventional methods 6 to 10, an epoxy resin was added at 3 wt % and then mixed therewith, and each of the mixtures was compression-molded while applying a magnetic field of 1.6 MA/m in a compacting direction so as to produce a green compact with a cylindrical shape having a diameter of 10 mm and a height of 7 mm. Subsequently, the obtained cylindrical green compact was hardened in an oven at 150° C. for 2 hours so as to produce a cylindrical bonded magnet having a density of 6.0 to 6.1 g/cm$^3$. The obtained the bonded magnet was magnetized in pulsed magnetic field of a 70 kOe, and then held for 1,000 hours in an oven maintained at 100° C., and the thermal demagnetizing rates after 3 hours, 100 hours, and 1,000 hours were measured. Those results are shown in Table 10, and the thermal stability was evaluated.

In addition, the rare earth magnet powders obtained by using the present invention's method 6 to 10 and the conventional methods 6 to 10 were compression-molded in a magnetic field to produce anisotropic green compacts. These anisotropic green compacts were set in a hot-pressing apparatus, and hot pressing was carried out under the following conditions: pressing in parallel to the magnetic aligned direction; an Ar gas atmosphere; a temperature of 750° C.; a pressure of 58.8 MPa; and holding time of 1 minute. The hot pressing was following by quenching so as to produce hot-pressed magnets having a density of 7.5 to 7.7 g/cm$^3$. The magnetic properties of the obtained hot-pressed magnets are shown in Table 10. Also, the temperature coefficient of coercivity $\alpha_{iHc}$ was determined from the result of the magnetic properties measured at 150° C., and those values are shown in Table 10.

TABLE 6

| Type | | Ingot in Table 1 | Average particle diameter of rare earth magnet raw material powder obtained by milling ingot in Table 1 in Ar atmosphere (μm) | Mixed powder Amount of hydride added to rare earth magnet raw material powder (mol %) | | | Hydrogen absorption | | | Hydrogen absorption-decomposition | | |
|---|---|---|---|---|---|---|---|---|---|---|---|---|
| | | | | Dry hydride | Tb hydride | Dy—Tb alloy hydride | Hydrogen Pressure (kPa) | Holding temp. (° C.) | Holding time (min) | Hydrogen pressure (kPa) | Holding temp. (° C.) | Holding time (min) |
| Invention's method | 6 | f | 300 | 0.1 | — | — | 500 | 150 | 20 | 500 | 820 | 120 |
| Conventional method | | | — | | — | | | | | | | |
| Invention's method | 7 | g | 300 | — | 1.0 | — | 300 | 180 | 40 | 300 | 820 | 240 |
| Conventional method | | | — | | — | | | | | | | |
| Invention's method | 8 | h | 300 | — | — | 2.0 | 700 | 200 | 60 | 700 | 840 | 180 |
| Conventional method | | | — | | — | | | | | | | |
| Invention's method | 9 | i | 300 | 3.0 | — | — | 100 | 250 | 90 | 100 | 860 | 60 |
| Conventional method | | | — | | — | | | | | | | |
| Invention's method | 10 | j | 300 | | 5.0 | — | 900 | 300 | 120 | 900 | 880 | 120 |
| Conventional method | | | — | | — | | | | | | | |

TABLE 7

| Type | | Remarks | Intermediate heat treatment | | | Heat treatment in depressurized hydrogen | | |
|---|---|---|---|---|---|---|---|---|
| | | | Ar pressure (kPa) | Holding temp. (° C.) | Holding time (min) | Hydrogen pressure (kPa) | Holding temp. (° C.) | Holding time (min) |
| Invention's method | 6 | Continued from Table 6 | 500 | 820 | 5 | 2.6 | 820 | 120 |
| Conventional method | | | | | | | | |
| Invention's method | 7 | | | — | | 3.9 | 820 | 120 |
| Conventional method | | | | | | | | |
| Invention's method | 8 | | 700 | 840 | 10 | | — | |
| Conventional method | | | | | | 3.9 | 840 | 120 |
| Invention's method | 9 | | | — | | | — | |
| Conventional method | | | | | | 3.9 | 860 | 120 |
| Invention's method | 10 | | 900 | 880 | 8 | 8 | 880 | 240 |
| Conventional method | | | | | | | | |

TABLE 8

| Type | | Remarks | Average particle diameter of rare earth magnet raw material hydride powder obtained by heat-treating ingot in Table 1 in depressurized hydrogen, then milling (μm) | Hydrogen-containing raw material mixed powder Amount of Dy/Tb hydride added to rare earth magnet raw material hydride powder (mol %) | | | Diffusion heat-treatment | | | Hydrogen desorption | | |
|---|---|---|---|---|---|---|---|---|---|---|---|---|
| | | | | Dy hydride | Tb hydride | Dy—Tb alloy hydride | Pressure (kPa) | Holding temp. (° C.) | Holding time (min) | Ultimate pressure (kPa) | Holding temp. (° C.) | Holding time (min) |
| Invention's method | 6 | Continued from Table 7 | — | | — | | | — | | 0.066 | 820 | 12 |
| Conventional method | | | 300 | 1.0 | — | — | $1 \times 10^{-4}$ | 820 | 30 | $1 \times 10^{-4}$ | | 30 |
| Invention's method | 7 | | — | | — | | | — | | 0.026 | 820 | 16 |
| Conventional method | | | 300 | — | 1 | — | $1 \times 10^{-4}$ | 820 | 30 | $1 \times 10^{-4}$ | | 30 |
| Invention's method | 8 | | — | | — | | | — | | 0.013 | 820 | 9 |
| Conventional method | | | 300 | — | — | 2 | $1 \times 10^{-4}$ | 840 | 30 | $1 \times 10^{-4}$ | | 30 |
| Invention's method | 9 | | — | | — | | | — | | 0.013 | 820 | 7 |
| Conventional method | | | 300 | 3 | — | — | $1 \times 10^{-4}$ | 860 | 30 | $1 \times 10^{-4}$ | | 30 |
| Invention's method | 10 | | — | | — | | | — | | 0.013 | 820 | 10 |
| Conventional method | | | 300 | — | 5 | — | $1 \times 10^{-4}$ | 880 | 30 | $1 \times 10^{-4}$ | | 30 |

TABLE 9

| Type | | Remarks | Rare earth magnet powder | | | | |
|---|---|---|---|---|---|---|---|
| | | | EPMA detected intensity | | | Thickness | |
| | | | Peak value near surface (counts) | Peak value near center (counts) | Intensity ratio | of Dy—Tb rich layer (μm) | Coverage (%) |
| Invention's method | 6 | Continued from Table 8 | 1756 | 1451 | 1.21 | 0.1 | 70 |
| Conventional method | | | 1447 | 1492 | 0.97 | — | 0 |
| Invention's method | 7 | | 3344 | 1827 | 1.83 | 6.8 | 95 |
| Conventional method | | | 2367 | 2233 | 1.06 | — | 0 |
| Invention's method | 8 | | 2857 | 1043 | 2.74 | 10.1 | 100 |
| Conventional method | | | 2076 | 1854 | 1.12 | — | 0 |
| Invention's method | 9 | | 4588 | 1230 | 3.73 | 20.7 | 100 |
| Conventional method | | | 2274 | 1960 | 1.16 | — | 0 |
| Invention's method | 10 | | 17959 | 3896 | 4.61 | 25.6 | 100 |
| Conventional method | | | 7286 | 5923 | 1.23 | 1.0 | 20 |

TABLE 10

| Type | | Bonded magnet Br (T) | iHc (MA/m) | BHmax (KJ/m³) | $\alpha_{iHc}$ (%/° C.) | Hot-pressed magnet Br (T) | iHc (MA/m) | BHmax (KJ/m³) | $\alpha_{iHc}$ (%/° C.) | Thermal demagnetizing rate for bonded magnet after being held for time indicated below in 100° C. oven (%) 3 hours | 100 hours | 1,000 hours |
|---|---|---|---|---|---|---|---|---|---|---|---|---|
| Invention's method | 6 | 0.93 | 1.74 | 158 | −0.40 | 1.17 | 1.73 | 245 | −0.43 | −4.9 | −5.5 | −6.5 |
| Conventional method | | 0.91 | 1.73 | 149 | −0.41 | 1.15 | 1.71 | 236 | −0.44 | −5.4 | −7.2 | −10.7 |
| Invention's method | 7 | 0.95 | 1.78 | 166 | −0.38 | 1.20 | 1.76 | 255 | −0.41 | −4.8 | −5.4 | −6.4 |
| Conventional method | | 0.93 | 1.66 | 158 | −0.43 | 1.18 | 1.65 | 247 | −0.46 | −5.6 | −7.5 | −11.1 |
| Invention's method | 8 | 0.95 | 1.48 | 172 | −0.36 | 1.21 | 1.46 | 259 | −0.39 | −5.7 | −6.5 | −7.7 |
| Conventional method | | 0.94 | 1.25 | 165 | −0.42 | 1.19 | 1.24 | 252 | −0.45 | −7.5 | −10.0 | −14.8 |
| Invention's method | 9 | 0.94 | 1.53 | 165 | −0.35 | 1.19 | 1.51 | 252 | −0.37 | −5.5 | −6.3 | −7.5 |
| Conventional method | | 0.93 | 1.30 | 160 | −0.41 | 1.18 | 1.38 | 247 | −0.44 | −6.7 | −9.0 | −13.3 |
| Invention's method | 10 | 0.96 | 2.53 | 166 | −0.34 | 1.22 | 2.51 | 265 | −0.36 | −3.3 | −3.8 | −4.5 |
| Conventional method | | 0.96 | 2.04 | 164 | −0.40 | 1.22 | 2.02 | 263 | −0.43 | −4.6 | −6.1 | −9.1 |

On the basis of the results shown in Table 1 and Table 6 to 10, the magnetic properties of the bonded magnets and the hot-pressed magnets produced by using the rare earth magnet powders produced by the present invention's methods 6 to 10, in which a mixed powder was produced by milling a block in an Ar gas atmosphere followed by adding a hydride powder thereto, showed improvements in both coercivity and remanence when compared with the magnetic properties of bonded magnets and hot-pressed magnets produced by using the rare earth magnet powders produced by the conventional methods 6 to 10 in which milling was not carried out and a hydride was not added. Moreover, the temperature coefficient of the coercivity and the thermal demagnetizing rate were both small, indicating that each of the magnets obtained by the present invention's methods also had an excellent thermal stability.

Example 3

The present invention's methods 11 to 15 were carried out as follows. Blocks obtained from ingots k to o in Table 1 were milled in an Ar gas atmosphere to the average particle diameters shown in Table 11 so as to produce rare earth magnet alloy raw material powders. To these rare earth magnet alloy raw material powders, a Dy hydride powder, a Tb hydride powder, or a Dy—Tb binary alloy hydride powder, each of which has an average particle diameter of 5 μm was added at the amount shown in Table 11, and then mixed therewith so as to produce mixed powders. The respective mixed powders were then subjected to, in order, hydrogen absorption under the conditions shown in Table 11; hydrogen absorption-decomposition under the conditions shown in Table 11; if necessary, intermediate heat treatment under the conditions shown in Table 11; if necessary, heat treatment in depressurized hydrogen under the conditions shown in Table 11; hydrogen desorption under the conditions shown in Table 12; forcibly cooling to room temperature with Ar gas; and then pulverizing to 300 μm or below, thereby producing rare earth magnet powders.

Conventional Example 3

Conventional methods 11 to 15 were carried out as follows. Blocks obtained from ingots k to o in Table 1 were subjected to hydrogen absorption under the same conditions as in Example 3 and shown in Table 11 without milling the blocks nor adding a hydride powder so as to produce a mixed powder, and then were subjected to, in order, hydrogen absorption-decomposition under the same conditions as in Example 3 and shown in Table 11; if necessary, heat treatment in depressurized hydrogen under the conditions shown in Table 11; forcibly cooling to room temperature in Ar gas; and then milling treatment to the average particle diameter shown in Table 12 so as to produce rare earth magnet raw material hydride powders. Then, to these rare earth magnet raw material hydride powders, a Dy hydride powder, a Tb hydride powder, or a Dy—Tb binary alloy hydride powder, each of which has an average particle diameter of 5 μm, was added at the amount shown in Table 12 and then mixed therewith so as to produce hydrogen-containing raw material mixed powders. Each of these hydrogen-containing raw material mixed powders was subjected to diffusion heat-treating including heating in a vacuum followed by holding under the conditions shown in Table 12; hydrogen desorption under the conditions shown in Table 12; forcibly cooling to room temperature with Ar gas; and then pulverizing to 300 μm or below, thereby producing rare earth magnet powders.

Each of the rare earth magnet powders obtained by using the present invention's methods 11 to 15 and the conventional methods 11 to 15 was embedded in a phenolic resin and polished to a mirror surface, and the detected intensities of near-center and near-surface Dy and/or Tb and the intensity ratio thereof were measured by analysis with the EPMA, thereby determining the values of the depth of the Dy—Tb rich layer from the surface and of the surface coverage by the Dy—Tb rich layer. Those results are given in Table 13.

To each of the rare earth magnet powders obtained in the present invention's methods 11 to 15 and the conventional methods 11 to 15, an epoxy resin was added at 3 wt % and then mixed therewith, and each of the mixtures was compression-molded in a magnetic field of 1.6 MA/m so as to produce a green compact. The green compact was hardened in an oven at 150° C. for 2 hours so as to produce a bonded magnet having a density of 6.0 to 6.1 g/cm$^3$. The magnetic properties of the obtained bonded magnet are shown in Table 14. Also, the temperature coefficient of coercivity $\alpha_{iHc}$ for each magnet was determined from the result of the magnetic properties measured at 150° C., and those values are shown in Table 14.

Also, to each of the rare earth magnet powders obtained in the present invention's methods 11 to 15 and the conventional methods 11 to 15, an epoxy resin was added at 3 wt % and then mixed therewith, and each of the mixtures was compression-molded while applying a magnetic field of 1.6 MA/m in a compacting direction so as to produce a green compact with a cylindrical shape having a diameter of 10 mm and a height of 7 mm. Subsequently, the obtained cylindrical green compact was hardened in an oven at 150° C. for 2 hours so as to produce a cylindrical bonded magnet having a density of 6.0 to 6.1 g/cm$^3$. The obtained the bonded magnet was magnetized in pulsed magnetic field of a 70 kOe, and then held for 1,000 hours in an oven maintained at 100° C., and the thermal demagnetizing rates after 3 hours, 100 hours, and 1,000 hours were measured. Those results are shown in Table 14, and the thermal stability was evaluated.

In addition, the rare earth magnet powders obtained by using the present invention's method 11 to 15 and the conventional methods 11 to 15 were compression-molded in a magnetic field to produce anisotropic green compacts. These anisotropic green compacts were set in a hot-pressing apparatus, and hot pressing was carried out under the following conditions: pressing in parallel to the magnetic aligned direction; an Ar gas atmosphere; a temperature of 750° C.; a pressure of 58.8 MPa; and holding time of 1 minute. The hot pressing was following by quenching so as to produce hot-pressed magnets having a density of 7.5 to 7.7 g/cm$^3$. The magnetic properties of the obtained hot-pressed magnets are shown in Table 14. Also, the temperature coefficient of coercivity $\alpha_{iHc}$ was determined from the result of the magnetic properties measured at 150° C., and those values are shown in Table 14.

TABLE 11

| Type | | Ingot in Table 1 | Average particle diameter of rare earth magent raw material powder obtained by milling ingot in Table 1 in Ar atmosphere (μm) | Mixed powder Amount of hydride added to rare earth magnet raw material powder (mol %) Dy hydride | Tb hydride | Dy—Tb alloy hydride | Hydrogen absorption | Hydrogen absorption-decomposition | Intermediate heat treatment Ar pressure (kPa) | Hold-ing temp. (° C.) | Hold-ing time (min) | Heat treatment in depressurized hydrogen Hydro-gen pressure (kPa) | Hold-ing temp. (° C.) | Holding time (min) |
|---|---|---|---|---|---|---|---|---|---|---|---|---|---|---|
| Invention's method | 11 | k | 10 | 0.5 | — | — | Hydrogen partial pressure: 200 kPa Holding temp.: 150° C. Holding time: 20 min | Hydrogen partial pressure: 200 kPa Holding temp.: 820° C. Holding time: 120 min | 200 | 820 | 5 | 3.9 | 820 | 120 |
| Conventional method | | | — | | — | | | | — | — | — | | | |
| Invention's method | 12 | l | 50 | — | — | 1.5 | | | | — | | 3.9 | 820 | 120 |
| Conventional method | | | — | | — | | | | | | | | | |
| Invention's method | 13 | m | 100 | 1.0 | 1.0 | — | | | 200 | 820 | 5 | | — | |
| Conventional method | | | — | | — | | | | — | — | — | 3.9 | 820 | 120 |
| Invention's method | 14 | n | 200 | — | 2.0 | 2.0 | | | | — | | | — | |
| Conventional method | | | — | | — | | | | | | | 3.9 | 820 | 120 |
| Invention's method | 15 | o | 500 | 2.0 | — | — | | | 200 | 820 | 5 | 3.9 | 820 | 120 |
| Conventional method | | | — | | — | | | | — | — | — | | | |

TABLE 12

| Type | | Remarks | Average particle diameter of rare earth magnet raw material hydride powder obtained by heat-treating ingot in Table 1 in depressurized hydrogen, then milling (μm) | Hydrogen-containing raw material mixed powder Amount of Dy/Tb hydride added to rare earth magnet raw material hydride powder (mol %) | | | Diffusion heat-treatment | | | Hydrogen desorption | | |
|---|---|---|---|---|---|---|---|---|---|---|---|---|
| | | | | Dy hydride | Tb hydride | Dy—Tb alloy hydride | Pressure (kPa) | Holding temp. (° C.) | Holding time (min) | Ultimate pressure (kPa) | Holding temp. (° C.) | Holding time (min) |
| Invention's method | 11 | Continued from Table 11 | — | | — | | | — | | 0.013 | 820 | 8 |
| Conventional method | | | 10 | 0.5 | — | — | $1 \times 10^{-4}$ | 820 | 30 | $1 \times 10^{-4}$ | | 30 |
| Invention's method | 12 | | — | | — | | | — | | 0.013 | | 13 |
| Conventional method | | | 50 | — | — | 1.5 | $1 \times 10^{-4}$ | 820 | 30 | $1 \times 10^{-4}$ | | 30 |
| Invention's method | 13 | | — | | — | | | — | | 0.013 | | 7 |
| Conventional method | | | 100 | 1 | 1 | | $1 \times 10^{-4}$ | 820 | 30 | $1 \times 10^{-4}$ | | 30 |
| Invention's method | 14 | | — | | — | | | — | | 0.013 | | 9 |
| Conventional method | | | 200 | — | 2 | 2 | $1 \times 10^{-4}$ | 820 | 30 | $1 \times 10^{-4}$ | | 30 |
| Invention's method | 15 | | — | | — | | | — | | 0.013 | | 12 |
| Conventional method | | | 500 | 2 | — | — | $1 \times 10^{-4}$ | 820 | 30 | $1 \times 10^{-4}$ | | 30 |

TABLE 13

| Type | | Remarks | Rare earth magnet powder | | | | |
|---|---|---|---|---|---|---|---|
| | | | EPMA detected intensity | | | Thickness | |
| | | | Peak value near surface (counts) | Peak value near center (counts) | Intensity ratio | of Dy—Tb rich layer (μm) | Coverage (%) |
| Invention's method | 11 | Continued from Table 12 | 2386 | 1549 | 1.54 | 4.9 | 85 |
| Conventional method | | | 1760 | 1752 | 1.00 | — | 0 |
| Invention's method | 12 | | 3071 | 1458 | 2.10 | 7.8 | 100 |
| Conventional method | | | 2253 | 2067 | 1.09 | — | 0 |
| Invention's method | 13 | | 2727 | 1330 | 2.05 | 11.4 | 100 |
| Conventional method | | | 2017 | 1817 | 1.11 | — | 0 |
| Invention's method | 14 | | 8936 | 2377 | 3.76 | 20.9 | 100 |
| Conventional method | | | 4054 | 3350 | 1.21 | 0.5 | 10 |
| Invention's method | 15 | | 3089 | 953 | 3.24 | 12.0 | 100 |
| Conventional method | | | 1627 | 1440 | 1.13 | — | 0 |

TABLE 14

| Type | | Bonded magnet Br (T) | iHc (MA/m) | BHmax (KJ/m³) | $\alpha_{iHc}$ (%/° C.) | Hot-pressed magnet Br (T) | iHc (MA/m) | BHmax (KJ/m³) | $\alpha_{iHc}$ (%/° C.) | Thermal demagnetizing rate for bonded magnet after being held for time indicated below in 100° C. oven (%) 3 hours | 100 hours | 1,000 hours |
|---|---|---|---|---|---|---|---|---|---|---|---|---|
| Invention's method | 11 | 0.95 | 1.70 | 160 | −0.39 | 1.20 | 1.68 | 256 | −0.42 | −5.0 | −5.7 | −6.7 |
| Conventional method | | 0.93 | 1.61 | 152 | −0.42 | 1.18 | 1.59 | 247 | −0.45 | −5.8 | −7.8 | −11.5 |
| Invention's method | 12 | 0.93 | 1.73 | 157 | −0.37 | 1.18 | 1.71 | 249 | −0.40 | −4.9 | −5.6 | −6.6 |
| Conventional method | | 0.92 | 1.58 | 150 | −0.43 | 1.17 | 1.56 | 242 | −0.46 | −5.9 | −7.9 | −11.7 |
| Invention's method | 13 | 0.96 | 1.47 | 171 | −0.36 | 1.22 | 1.45 | 264 | −0.39 | −5.8 | −6.6 | −7.8 |
| Conventional method | | 0.95 | 1.31 | 165 | −0.44 | 1.20 | 1.30 | 258 | −0.47 | −7.1 | −9.5 | −14.1 |
| Invention's method | 14 | 0.95 | 2.13 | 165 | −0.36 | 1.20 | 2.11 | 256 | −0.39 | −4.0 | −4.5 | −5.4 |
| Conventional method | | 0.94 | 1.79 | 161 | −0.43 | 1.19 | 1.77 | 252 | −0.46 | −5.2 | −7.0 | −10.3 |
| Invention's method | 15 | 0.97 | 1.43 | 179 | −0.36 | 1.23 | 1.42 | 270 | −0.39 | −5.9 | −6.7 | −8.0 |
| Conventional method | | 0.96 | 1.23 | 172 | −0.45 | 1.22 | 1.22 | 263 | −0.48 | −7.6 | −10.1 | −15.0 |

On the basis of the results shown in Table 1 and Table 11 to 14, the magnetic properties of the bonded magnets and the hot-pressed magnets produced by using the rare earth magnet powders produced by the present invention's methods 11 to 15, in which a mixed powder was produced by milling a block in an Ar gas atmosphere followed by adding a hydride powder thereto, showed improvements in both coercivity and remanence when compared with the magnetic properties of bonded magnets and hot-pressed magnets produced by using the rare earth magnet powders produced by the conventional methods 11 to 15 in which milling was not carried out and a hydride was not added. Moreover, the temperature coefficient of the coercivity and the thermal demagnetizing rate were both small, indicating that each of the magnets obtained by the present invention's methods also had an excellent thermal stability.

Example 4

The present invention's methods 16 to 20 were carried out as follows. Blocks obtained from ingots a to e in Table 1 was subjected to hydrogen absorption under the conditions shown in Table 15. Then, these blocks subjected to the hydrogen absorption were milled to the average particle diameters shown in Table 15 so as to produce hydrogen-absorbing rare earth magnet alloy raw material powders. To these hydrogen-absorbing rare earth magnet alloy raw material powders, a Dy hydride powder, a Tb hydride powder, or a Dy—Tb binary alloy hydride powder, each of which has an average particle diameter of 5 μm was added at the amount shown in Table 15, and then mixed therewith so as to produce hydrogen-containing raw material mixed powders. The respective hydrogen-containing raw material mixed powders were then subjected to, in order, hydrogen absorption-decomposition under the conditions shown in Table 15; if necessary, intermediate heat treatment under the conditions shown in Table 15; if necessary, heat treatment in depressurized hydrogen under the conditions shown in Table 15; hydrogen desorption under the conditions shown in Table 16; forcibly cooling to room temperature with Ar gas; and then pulverizing to 300 μm or below, thereby producing rare earth magnet powders.

Conventional Example 4

Conventional methods 16 to 20 were carried out as follows. Blocks obtained from ingots a to e in Table 1 were subjected to hydrogen absorption under the conditions as shown in Table 15 followed by hydrogen absorption-decomposition under the same conditions as in Example 4 and shown in Table 15 without milling the blocks nor adding a hydride powder so as not to produce a hydrogen-containing raw material mixed powder, and then were subjected to, in order, if necessary, heat treatment in depressurized hydrogen under the conditions shown in Table 15; forcibly cooling to room temperature in Ar gas; and then milling treatment to the average particle diameter shown in Table 16 so as to produce rare earth magnet raw material hydride powders. To these rare earth magnet raw material hydride powders, a Dy hydride powder, a Tb hydride powder, or a Dy—Tb binary alloy hydride powder, each of which has an average particle diameter of 5 μm, was added at the amount shown in Table 16 and then mixed therewith so as to produce hydrogen-containing raw material mixed powders. Each of these hydrogen-containing raw material mixed powders was subjected to diffusion heat-treating including heating in a vacuum followed by holding under the conditions shown in Table 16; hydrogen desorption under the conditions shown in Table 16; forcibly cooling to room temperature with Ar gas; and then pulverizing to 300 μm or below, thereby producing rare earth magnet powders.

Each of the rare earth magnet powders obtained by using the present invention's methods 16 to 20 and the conventional methods 16 to 20 was embedded in a phenolic resin and polished to a mirror surface, and the detected intensities of near-center and near-surface Dy and/or Tb, and the intensity ratio thereof were measured by analysis with the EPMA, thereby determining the values of the depth of the Dy—Tb rich layer from the surface and of the surface coverage by the Dy—Tb rich layer. Those results are given in Table 17.

Figure 6:
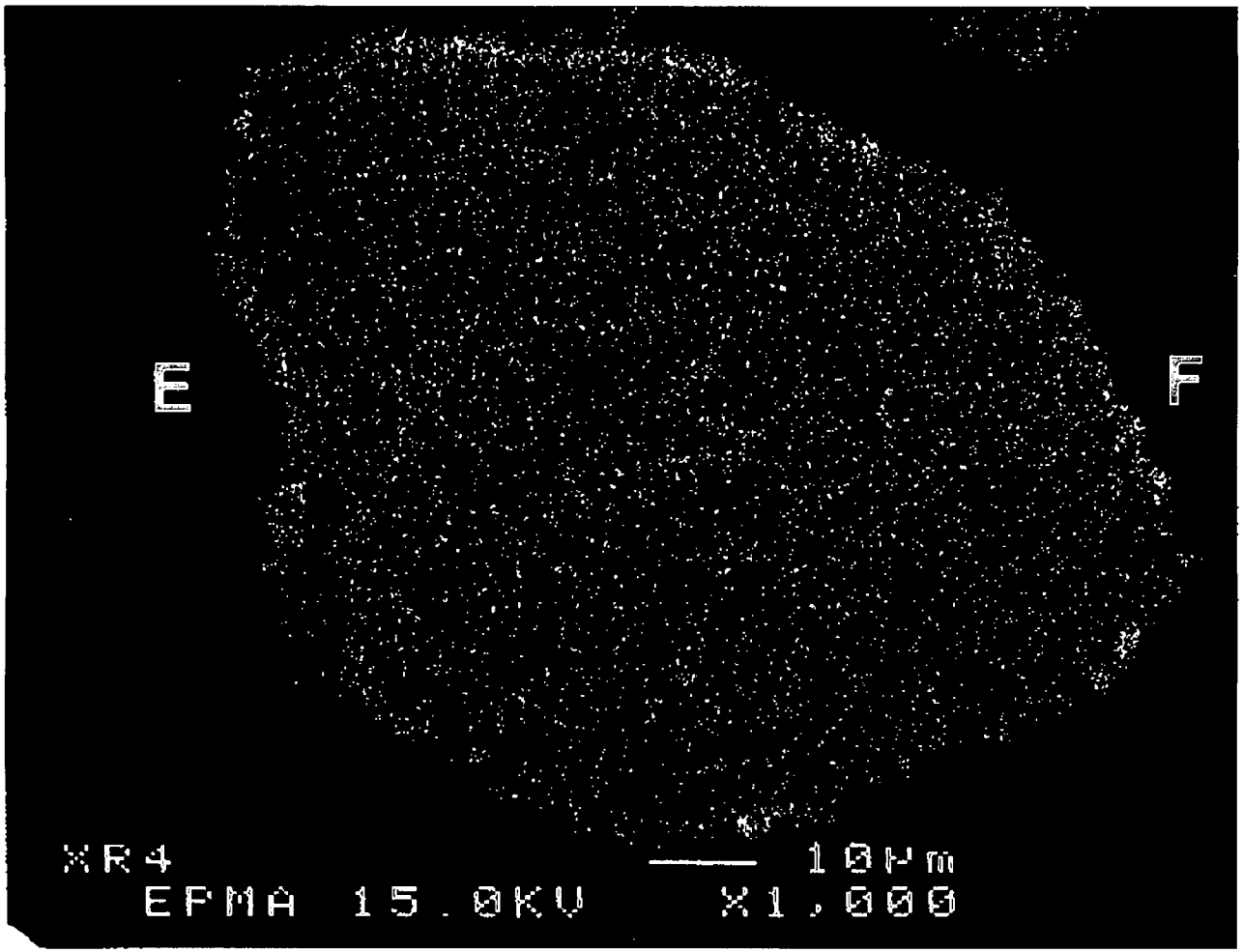
FIG. 6 is an elemental distribution image obtained by using an electron probe microanalyzer (EPMA), which shows the elemental distribution of Dy contained in the anisotropic magnet powder produced by the present invention's method 16.
Figure 7:
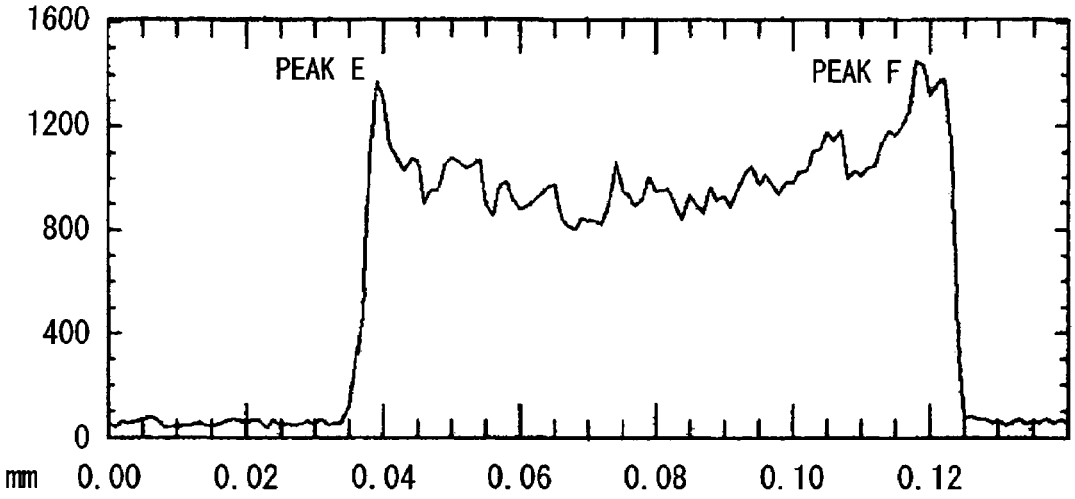
FIG. 7 is a line analysis graph obtained by using an electron probe microanalyzer (EPMA), which shows the distribution of Dy on line E-F in FIG. 6 of Dy contained in the anisotropic magnet powder produced by the present invention's method 16.

As an example, FIG. 6 shows an image of the elemental distribution of Dy taken when the rare earth magnet powder obtained by the present invention's method 16 was embedded in phenolic resin and polished to a mirror surface; then, the elemental distribution of Dy in an internal cross-section of the powder was examined with the EPMA. The presence of numerous bright points near the peripheral edge of the cross-section indicates that the Dy content in a powder particle is higher near the surface than near the center. FIG. 7 shows the results of a line analysis of Dy actually carried out with the EPMA on a straight line from point E to point F in FIG. 6. According to FIG. 7, strong peaks appear at both ends, indicating that the Dy content in the powder particle is higher near the surface than near the center. The average detected intensity of the peaks at both ends was 1412 counts, and the average detected intensity in a region near the center corresponding to ⅓ of the powder particle diameter was 915 counts; thus, the ratio of the intensity near the surface relative to the intensity near the center was 1.54. From the result of similar line analyses which were carried out ten times, each time at a different sample orientation, the surface coverage was found to be 95%. Also, from the result of scanning the peaks at both ends at a fine interval, the region where the intensity was at least 1.2 times the detected intensity near the center was found to have a width of 4.5 μm.

The values shown in Table 17 were obtained in this way from the measurement results for the rare earth magnet powder produced by the present invention's method 16 and from measurement results for the rare earth magnet powders produced also by the present invention's method 17 to 20 and the conventional methods 16 to 20.

In addition, to each of the rare earth magnet powders obtained in the present invention's methods 16 to 20 and the conventional methods 16 to 20, an epoxy resin was added at 3 wt % and then mixed therewith, and each of the mixtures was compression-molded in a magnetic field of 1.6 MA/m so as to produce a green compact. The green compact was hardened in an oven at 150° C. for 2 hours so as to produce a bonded magnet having a density of 6.0 to 6.1 g/cm$^3$. The magnetic properties of the obtained bonded magnet are shown in Table 18. Also, the temperature coefficient of coercivity $\alpha_{iHc}$ for each magnet was determined from the result of the magnetic properties measured at 150° C., and those values are shown in Table 18. Herein, the temperature coefficient of coercivity $\alpha_{iHc}$ is the value obtained as follows: $\alpha_{iHc}$ (%/° C.)=[{(coercivity at 150° C.−coercivity at room temperature (20° C.))/coercivity at room temperature (20° C.)}/(150−20)]×100.

In addition, the rare earth magnet powders obtained by using the present invention's method 16 to 20 and the conventional methods 16 to 20 were compression-molded in a magnetic field to produce anisotropic green compacts. These anisotropic green compacts were set in a hot-pressing apparatus, and hot pressing was carried out under the following conditions: pressing in parallel to the magnetic aligned direction; an Ar gas atmosphere; a temperature of 750° C.; a pressure of 58.8 MPa; and holding time of 1 minute. The hot pressing was following by quenching so as to produce hot-pressed magnets having a density of 7.5 to 7.7 g/cm$^3$. The magnetic properties of the obtained hot-pressed magnets are shown in Table 18. Also, the temperature coefficient of coercivity $\alpha_{iHc}$ was determined from the result of the magnetic properties measured at 150° C., and those values are shown in Table 18.

Also, to each of the rare earth magnet powders obtained in the present invention's methods 16 to 20 and the conventional methods 16 to 20, an epoxy resin was added at 3 wt % and then mixed therewith, and each of the mixtures was compression-molded while applying a magnetic field of 1.6 MA/m in a compacting direction so as to produce a green compact with a cylindrical shape having a diameter of 10 mm and a height of 7 mm. Subsequently, the obtained cylindrical green compact was hardened in an oven at 150° C. for 2 hours so as to produce a cylindrical bonded magnet having a density of 6.0 to 6.1 g/cm$^3$. To determine their magnetic properties, the obtained the bonded magnet was magnetized in pulsed magnetic field of a 70 kOe, and then held for 1,000 hours in an oven maintained at 100° C., and the thermal demagnetizing rates after 3 hours, 100 hours, and 1,000 hours were measured. Those results are shown in Table 18, and the thermal stability was evaluated.

Herein, a "thermal demagnetizing rate" refers to the value obtained as follows: thermal demagnetizing rate (%)={(total magnetic flux after exposure for a predetermined hours−total magnetic flux before exposure)/total magnetic flux before exposure}×100.

TABLE 15

| | | Ingot | | Average particle diameter of rare earth magnet raw material powder obtained by milling ingot in | Mixed powder Amount of hydride added to rare earth magnet raw material powder (mol %) | | | Hydrogen absorption-decomposition | Intermediate heat treatment | | | Heat treatment in depressurized hydrogen | | |
|---|---|---|---|---|---|---|---|---|---|---|---|---|---|---|
| Type | | in Table 1 | Hydrogen absorption | Table 1 in Ar atmosphere (μm) | Dy hydride | Tb hydride | Dy—Tb alloy hydride | | Ar pressure (kPa) | Holding temp. (° C.) | Holding time (min) | Hydrogen pressure (kPa) | Holding temp. (° C.) | Holding time (min) |
| Invention's method | 16 | a | Hydrogen partial pressure: 200 kPa | 300 | 0.9 | — | — | Hydrogen partial pressure: 200 kPa | 200 | 820 | 5 | 3.9 | 820 | 120 |
| Conventional method | | | | — | | — | | | | — | — | | | |

TABLE 15-continued

| Type | Ingot | in Table 1 | Hydrogen absorption | Average particle diameter of rare earth magnet raw material powder obtained by milling ingot in Table 1 in Ar atmosphere (μm) | Mixed powder Amount of hydride added to rare earth magnet raw material powder (mol %) Dy hydride | Tb hydride | Dy—Tb alloy hydride | Hydrogen absorption-decomposition | Intermediate heat treatment Ar pressure (kPa) | Holding temp. (° C.) | Holding time (min) | Heat treatment in depressurized hydrogen Hydrogen pressure (kPa) | Holding temp. (° C.) | Holding time (min) |
|---|---|---|---|---|---|---|---|---|---|---|---|---|---|---|
| Invention's method | 17 | b | Holding temp.: 150° C. Holding time: 20 min | 300 | — | 0.9 | — | Holding temp.: 820° C. Holding time: 120 min | | — | | 3.9 | 820 | 120 |
| Conventional method | | | | — | | — | | | | | | | | |
| Invention's method | 18 | c | | 300 | — | — | 0.9 | | 200 | 820 | 5 | | — | |
| Conventional method | | | | — | | — | | | | — | — | 3.9 | 820 | 120 |
| Invention's method | 19 | d | | 300 | 0.45 | 0.45 | — | | | — | | | — | |
| Conventional method | | | | — | | — | | | | | | 3.9 | 820 | 120 |
| Invention's method | 20 | e | | 300 | 0.3 | 0.3 | 0.3 | | 200 | 820 | 5 | 3.9 | 820 | 120 |
| Conventional method | | | | — | | — | | | — | — | — | | | |

TABLE 16

| Type | | Remarks | Average particle diameter of rare earth magnet raw material hydride powder obtained by heat-treating ingot in Table 1 in depressurized hydrogen, then milling (μm) | Hydrogen-containing raw material mixed powder Amount of Dy/Tb hydride added to rare earth magnet raw material hydride powder (mol %) Dy hydride | Tb hydride | Dy—Tb alloy hydride | Diffusion heat-treatment Pressure (kPa) | Holding temp. (° C.) | Holding time (min) | Hydrogen desorption Ultimate pressure (kPa) | Holding temp. (° C.) | Holding time (min) |
|---|---|---|---|---|---|---|---|---|---|---|---|---|
| Invention's method | 16 | Continued from Table 15 | — | | — | | | — | | 0.013 | 820 | 10 |
| Conventional method | | | 300 | 0.9 | — | — | $1 \times 10^{-4}$ | 820 | 30 | $1 \times 10^{-4}$ | 820 | 30 |
| Invention's method | 17 | | — | | — | | | — | | 0.013 | 820 | 9 |
| Conventional method | | | 300 | — | 0.9 | — | $1 \times 10^{-4}$ | 820 | 30 | $1 \times 10^{-4}$ | 820 | 30 |
| Invention's method | 18 | | — | | — | | | — | | 0.013 | 820 | 10 |
| Conventional method | | | 300 | — | — | 0.9 | $1 \times 10^{-4}$ | 820 | 30 | $1 \times 10^{-4}$ | 820 | 30 |
| Invention's method | 19 | | — | | — | | | — | | 0.013 | 820 | 8 |
| Conventional method | | | 300 | 0.45 | 0.45 | — | $1 \times 10^{-4}$ | 820 | 30 | $1 \times 10^{-4}$ | 820 | 30 |
| Invention's method | 20 | | — | | — | | | — | | 0.013 | 820 | 11 |
| Conventional method | | | 300 | 0.3 | 0.3 | 0.3 | $1 \times 10^{-4}$ | 820 | 30 | $1 \times 10^{-4}$ | 820 | 30 |

TABLE 17

| Type | | Remarks | Rare earth magnet powder: EPMA detected intensity: Peak value near surface (counts) | Peak value near center (counts) | Intensity ratio | Thickness of Dy—Tb rich layer (μm) | Coverage (%) |
|---|---|---|---|---|---|---|---|
| Invention's method | 16 | Continued from Table 16 | 1412 | 915 | 1.54 | 4.5 | 95 |
| Conventional method | | | 1180 | 1176 | 1.00 | — | 0 |
| Invention's method | 17 | | 3880 | 1813 | 2.14 | 7.9 | 95 |
| Conventional method | | | 2160 | 2182 | 0.99 | — | 0 |
| Invention's method | 18 | | 2694 | 1361 | 1.98 | 6.3 | 90 |
| Conventional method | | | 1685 | 1668 | 1.01 | — | 0 |
| Invention's method | 19 | | 1676 | 842 | 1.99 | 6.3 | 95 |
| Conventional method | | | 1257 | 1252 | 1.00 | — | 0 |
| Invention's method | 20 | | 1494 | 879 | 1.70 | 5.4 | 100 |
| Conventional method | | | 1315 | 1289 | 1.02 | — | 0 |

TABLE 18

| Type | | Bonded magnet: Br (T) | iHc (MA/m) | BHmax (KJ/m$^3$) | $\alpha_{iHc}$ (%/° C.) | Hot-pressed magnet: Br (T) | iHc (MA/m) | BHmax (KJ/m$^3$) | $\alpha_{iHc}$ (%/° C.) | Thermal demagnetizing rate for bonded magnet after being held for time indicated below in 100° C. oven (%): 3 hours | 100 hours | 1,000 hours |
|---|---|---|---|---|---|---|---|---|---|---|---|---|
| Invention's method | 16 | 1.00 | 1.15 | 190 | −0.37 | 1.26 | 1.14 | 283 | −0.40 | −7.6 | −8.7 | −10.3 |
| Conventional method | | 0.98 | 1.05 | 179 | −0.45 | 1.24 | 1.04 | 274 | −0.48 | −8.9 | −11.9 | −17.6 |
| Invention's method | 17 | 0.94 | 1.67 | 159 | −0.35 | 1.19 | 1.65 | 251 | −0.37 | −5.2 | −6.0 | −7.1 |
| Conventional method | | 0.92 | 1.53 | 150 | −0.43 | 1.17 | 1.51 | 242 | −0.46 | −6.1 | −8.2 | −12.1 |
| Invention's method | 18 | 0.96 | 1.69 | 173 | −0.38 | 1.21 | 1.67 | 262 | −0.41 | −5.2 | −5.9 | −7.0 |
| Conventional method | | 0.94 | 1.57 | 163 | −0.44 | 1.19 | 1.55 | 252 | −0.47 | −6.0 | −8.0 | −11.8 |
| Invention's method | 19 | 0.98 | 1.31 | 187 | −0.37 | 1.24 | 1.30 | 273 | −0.40 | −6.7 | −7.6 | −9.0 |
| Conventional method | | 0.96 | 1.19 | 176 | −0.45 | 1.22 | 1.18 | 263 | −0.48 | −7.8 | −10.5 | −15.5 |
| Invention's method | 20 | 0.95 | 1.27 | 173 | −0.38 | 1.20 | 1.26 | 256 | −0.41 | −6.9 | −7.9 | −9.3 |
| Conventional method | | 0.93 | 1.15 | 164 | −0.46 | 1.18 | 1.14 | 247 | −0.49 | −8.1 | −10.8 | −16.0 |

On the basis of the results shown in Table 1 and Table 15 to 18, the magnetic properties of the bonded magnets and the hot-pressed magnets produced by using the rare earth magnet powders produced by the present invention's methods 16 to 20, in which a hydrogen-containing raw material mixed powder was produced by adding a hydride powder to a hydrogen-absorbing rare earth magnet raw material powder, and this hydrogen-containing raw material mixed powder was subjected to hydrogen absorption-decomposition, showed improvements in both coercivity and remanence when compared with the magnetic properties of bonded magnets and hot-pressed magnets produced by using the rare earth magnet powders produced by the conventional methods 16 to 20 in which a hydrogen-containing raw material mixed powder was obtained by adding a hydride powder to a rare earth magnet raw material hydride powder obtained by hydrogen absorption followed by hydrogen absorption-decomposition, and this hydrogen-containing raw material mixed powder was diffusion heat-treated. Moreover, the temperature coefficient of the coercivity and the thermal demagnetizing rate were both small, indicating that each of the magnets obtained by the present invention's methods also had an excellent thermal stability.

Example 5

The present invention's methods 21 to 25 were carried out as follows. Blocks obtained from ingots f to j in Table 1 was subjected to hydrogen absorption under the conditions shown in Table 19. Then, these blocks subjected to the hydrogen absorption were milled to the average particle diameters shown in Table 19 so as to produce hydrogen-absorbing rare earth magnet alloy raw material powders. To these rare earth magnet alloy raw material powders subjected to hydrogen absorption, a Dy hydride powder, a Tb hydride powder, or a Dy—Tb binary alloy hydride powder, each of which has an average particle diameter of 5 μm was added at the amount shown in Table 19, and then mixed therewith so as to produce hydrogen-containing raw material mixed powders. The respective hydrogen-containing raw material mixed powders were then subjected to, in order, hydrogen absorption-decomposition under the conditions shown in Table 19; if necessary, intermediate heat treatment under the conditions shown in Table 19; if necessary, heat treatment in depressurized hydrogen under the conditions shown in Table 20; hydrogen desorption under the conditions shown in Table 20; forcibly cooling to room temperature with Ar gas; and then pulverizing to 300 μm or below, thereby producing rare earth magnet powders.

Conventional Example 5

Conventional methods 21 to 25 were carried out as follows. Blocks obtained from ingots f to j in Table 1 were subjected to hydrogen absorption under the same conditions as in Example 5 and shown in Table 19 followed by hydrogen absorption-decomposition under the same conditions as in Example 5 and shown in Table 19, and then were subjected to, in order, if necessary, heat treatment in depressurized hydrogen under the conditions shown in Table 20; forcibly cooling to room temperature in Ar gas; and then milling treatment to the average particle diameter shown in Table 20 so as to produce rare earth magnet raw material hydride powders. To these rare earth magnet raw material hydride powders, a Dy hydride powder, a Tb hydride powder, or a Dy—Tb binary alloy hydride powder, each of which has an average particle diameter of 5 μm, was added at the amount shown in Table 20 and then mixed therewith so as to produce hydrogen-containing raw material mixed powders. Each of these hydrogen-containing raw material mixed powders was subjected to diffusion heat-treating including heating in a vacuum followed by holding under the conditions shown in Table 20; hydrogen desorption under the conditions shown in Table 16; forcibly cooling to room temperature with Ar gas; and then pulverizing to 300 μm or below, thereby producing rare earth magnet powders.

Each of the rare earth magnet powders obtained by using the present invention's methods 21 to 25 and the conventional methods 21 to 25 was embedded in a phenolic resin and polished to a mirror surface, and the detected intensities of near-center and near-surface Dy and/or Tb, and the intensity ratio thereof were measured by analysis with the EPMA, thereby determining the values of the depth of the Dy—Tb rich layer from the surface and of the surface coverage by the Dy—Tb rich layer. Those results are given in Table 21.

In addition, to each of the rare earth magnet powders obtained in the present invention's methods 21 to 25 and the conventional methods 21 to 25, an epoxy resin was added at 3 wt % and then mixed therewith, and each of the mixtures was compression-molded in a magnetic field of 1.6 MA/m so as to produce a green compact. The green compact was hardened in an oven at 150° C. for 2 hours so as to produce a bonded magnet having a density of 6.0 to 6.1 g/cm$^3$. The magnetic properties of the obtained bonded magnet are shown in Table 22. Also, the temperature coefficient of coercivity $\alpha_{iHc}$ for each magnet was determined from the result of the magnetic properties measured at 150° C., and those values are shown in Table 22.

Also, to each of the rare earth magnet powders obtained in the present invention's methods 21 to 25 and the conventional methods 21 to 25, an epoxy resin was added at 3 wt % and then mixed therewith, and each of the mixtures was compression-molded while applying a magnetic field of 1.6 MA/m in a compacting direction so as to produce a green compact with a cylindrical shape having a diameter of 10 mm and a height of 7 mm. Subsequently, the obtained cylindrical green compact was hardened in an oven at 150° C. for 2 hours so as to produce a cylindrical bonded magnet having a density of 6.0 to 6.1 g/cm$^3$. To determine their magnetic properties, the obtained the bonded magnet was magnetized in pulsed magnetic field of a 70 kOe, and then held for 1,000 hours in an oven maintained at 100° C., and the thermal demagnetizing rates after 3 hours, 100 hours, and 1,000 hours were measured. Those results are shown in Table 22, and the thermal stability was evaluated.

In addition, the rare earth magnet powders obtained by using the present invention's method 21 to 25 and the conventional methods 21 to 25 were compression-molded in a magnetic field to produce anisotropic green compacts. These anisotropic green compacts were set in a hot-pressing apparatus, and hot pressing was carried out under the following conditions: pressing in parallel to the magnetic aligned direction; an Ar gas atmosphere; a temperature of 750° C.; a pressure of 58.8 MPa; and holding time of 1 minute. The hot pressing was following by quenching so as to produce hot-pressed magnets having a density of 7.5 to 7.7 g/cm$^3$. The magnetic properties of the obtained hot-pressed magnets are shown in Table 22. Also, the temperature coefficient of coercivity $\alpha_{iHc}$ was determined from the result of the magnetic properties measured at 150° C., and those values are shown in Table 22.

TABLE 19

| Type | | Ingot in Table 1 | Hydrogen absorption: Hydrogen pressure (kPa) | Hydrogen absorption: Holding temp. (° C.) | Hydrogen absorption: Holding time (min) | Average particle diameter of rare earth magnet raw material powder obtained by milling ingot in Table 1 in Ar atmosphere (μm) | Hydrogen-containing raw material mixed powder Amount of hydride added to hydrogenated rare earth magnet raw material powder (mol %): Dy hydride | Tb hydride | Dy—Tb alloy hydride | Hydrogen absorption-decomposition: Hydrogen pressure (kPa) | Holding temp. (° C.) | Holding time (min) | Intermediate heat treatment: Ar pressure (kPa) | Holding temp. (° C.) | Holding time (min) |
|---|---|---|---|---|---|---|---|---|---|---|---|---|---|---|---|
| Invention's method | 21 | f | 500 | 150 | 20 | 300 | 0.1 | — | — | 500 | 820 | 120 | 500 | 820 | 5 |
| Conventional method | | | | | | — | | — | | | | | — | — | — |
| Invention's method | 22 | g | 300 | 180 | 40 | 300 | — | 1.0 | — | 300 | 820 | 240 | — | — | — |
| Conventional method | | | | | | — | | — | | | | | | | |
| Invention's method | 23 | h | 700 | 200 | 60 | 300 | — | — | 2.0 | 700 | 840 | 180 | 700 | 840 | 10 |
| Conventional method | | | | | | — | | — | | | | | — | — | — |
| Invention's method | 24 | i | 100 | 250 | 90 | 300 | 3.0 | — | — | 100 | 860 | 60 | — | — | — |
| Conventional method | | | | | | — | | — | | | | | | | |
| Invention's method | 25 | j | 900 | 300 | 120 | 300 | — | 5.0 | — | 900 | 880 | 120 | 900 | 880 | 8 |
| Conventional method | | | | | | — | | — | | | | | | | |

TABLE 20

| Type | | Remarks | Heat treatment in pressure-reduced hydrogen: Hydrogen Pressure (kPa) | Holding temp. (° C.) | Holding time (min) | Average particle diameter of rare earth magnet raw material hydride powder obtained by hydrogen absorption-decomposition, optionally heat treating in depressurized hydrogen, and then milling ingot in Table 1 (μm) | Hydrogen-containing raw material mixed powder Amount of hydride added to rare earth magnet raw material hydride powder (mol %): Dy hydride | Tb hydride | Dy—Tb alloy hydride |
|---|---|---|---|---|---|---|---|---|---|
| Invention's method | 21 | Cont'd from Table 19 | 2.6 | 820 | 120 | — | | — | |
| Conventional method | | | | | | 300 | 0.1 | — | — |
| Invention's method | 22 | | 3.9 | 820 | 120 | — | | — | |
| Conventional method | | | | | | 300 | — | 1 | — |
| Invention's method | 23 | | | — | | — | | — | |
| Conventional method | | | 3.9 | 840 | 120 | 300 | — | — | 2 |
| Invention's method | 24 | | | — | | — | | — | |
| Conventional method | | | 3.9 | 860 | 120 | 300 | 3 | — | — |
| Invention's method | 25 | | 8 | 880 | 240 | — | | — | |
| Conventional method | | | | | | 300 | — | 5 | — |

TABLE 20-continued

| Type | | Diffusion heat-treatment Pressure (kPa) | Holding temp. (° C.) | Holding time (min) | Hydrogen desorption Ultimate Pressure (kPa) | Holding temp. (° C.) | Holding time (min) |
|---|---|---|---|---|---|---|---|
| Invention's method | 21 | | — | | 0.066 | 820 | 12 |
| Conventional method | | $1 \times 10^{-4}$ | 820 | 30 | $1 \times 10^{-4}$ | | 30 |
| Invention's method | 22 | | — | | 0.026 | 820 | 16 |
| Conventional method | | $1 \times 10^{-4}$ | 820 | 30 | $1 \times 10^{-4}$ | | 30 |
| Invention's method | 23 | | — | | 0.013 | 840 | 9 |
| Conventional method | | $1 \times 10^{-4}$ | 840 | 30 | $1 \times 10^{-4}$ | | 30 |
| Invention's method | 24 | | — | | 0.013 | 860 | 7 |
| Conventional method | | $1 \times 10^{-4}$ | 860 | 30 | $1 \times 10^{-4}$ | | 30 |
| Invention's method | 25 | | — | | 0.013 | 880 | 10 |
| Conventional method | | $1 \times 10^{-4}$ | 880 | 30 | $1 \times 10^{-4}$ | | 30 |

TABLE 21

| Type | | Remarks | Rare earth magnet powder: EPMA detected intensity: Peak value near surface (counts) | Peak value near center (counts) | Intensity ratio | Thickness of Dy—Tb rich layer (μm) | Coverage (%) |
|---|---|---|---|---|---|---|---|
| Invention's method | 21 | Continued from Table 20 | 1880 | 1446 | 1.24 | 0.2 | 75 |
| Conventional method | | | 1447 | 1492 | 0.97 | — | 0 |
| Invention's method | 22 | | 3377 | 1777 | 1.90 | 7.0 | 90 |
| Conventional method | | | 2367 | 2233 | 1.06 | — | 0 |
| Invention's method | 23 | | 2771 | 947 | 2.94 | 10.9 | 100 |
| Conventional method | | | 2076 | 1854 | 1.12 | — | 0 |
| Invention's method | 24 | | 4492 | 1140 | 3.94 | 21.9 | 100 |
| Conventional method | | | 2274 | 1960 | 1.16 | — | 0 |
| Invention's method | 25 | | 17790 | 3646 | 4.88 | 27.1 | 100 |
| Conventional method | | | 7286 | 5923 | 1.23 | 1.0 | 20 |

TABLE 22

| Type | | Bonded magnet | | | | Hot-pressed magnet | | | | Thermal demagnetizing rate for bonded magnet after being held for time indicated below in 100° C. oven (%) | | |
|---|---|---|---|---|---|---|---|---|---|---|---|---|
| | | Br (T) | iHc (MA/m) | BHmax (KJ/m$^3$) | $\alpha_{iHc}$ (%/° C.) | Br (T) | iHc (MA/m) | BHmax (KJ/m$^3$) | $\alpha_{iHc}$ (%/° C.) | 3 hours | 100 hours | 1,000 hours |
| Invention's method | 21 | 0.93 | 1.74 | 159 | −0.40 | 1.18 | 1.73 | 247 | −0.43 | −5.0 | −5.7 | −6.8 |
| Conventional method | | 0.91 | 1.73 | 149 | −0.41 | 1.15 | 1.71 | 236 | −0.44 | −5.4 | −7.2 | −10.7 |
| Invention's method | 22 | 0.95 | 1.78 | 167 | −0.38 | 1.20 | 1.76 | 256 | −0.41 | −4.9 | −5.6 | −6.7 |
| Conventional method | | 0.93 | 1.66 | 158 | −0.43 | 1.18 | 1.65 | 247 | −0.46 | −5.6 | −7.5 | −11.1 |
| Invention's method | 23 | 0.95 | 1.47 | 173 | −0.36 | 1.21 | 1.46 | 260 | −0.39 | −6.0 | −6.8 | −8.1 |
| Conventional method | | 0.94 | 1.25 | 165 | −0.42 | 1.19 | 1.24 | 252 | −0.45 | −7.5 | −10.0 | −14.8 |
| Invention's method | 24 | 0.94 | 1.51 | 166 | −0.35 | 1.19 | 1.50 | 253 | −0.37 | −5.8 | −6.6 | −7.8 |
| Conventional method | | 0.93 | 1.39 | 160 | −0.41 | 1.18 | 1.38 | 247 | −0.44 | −6.7 | −9.0 | −13.3 |
| Invention's method | 25 | 0.96 | 2.51 | 166 | −0.34 | 1.22 | 2.49 | 266 | −0.36 | −3.5 | −4.0 | −4.7 |
| Conventional method | | 0.96 | 2.04 | 164 | −0.40 | 1.22 | 2.02 | 263 | −0.43 | −4.6 | −6.1 | −9.1 |

On the basis of the results shown in Table 1 and Table 19 to 22, the magnetic properties of the bonded magnets and the hot-pressed magnets produced by using the rare earth magnet powders produced by the present invention's methods 21 to 25, in which a hydrogen-containing raw material mixed powder was produced by adding a hydride powder to a hydrogen-absorbing rare earth magnet raw material powder, and this hydrogen-containing raw material mixed powder was subjected to hydrogen absorption-decomposition, showed improvements in both coercivity and remanence when compared with the magnetic properties of bonded magnets and hot-pressed magnets produced by using the rare earth magnet powders produced by the conventional methods 21 to 25 in which a hydrogen-containing raw material mixed powder was obtained by adding a hydride powder to a rare earth magnet raw material hydride powder obtained by hydrogen absorption followed by hydrogen absorption-decomposition, and this hydrogen-containing raw material mixed powder was diffusion heat-treated. Moreover, the temperature coefficient of the coercivity and the thermal demagnetizing rate were both small, indicating that each of the magnets obtained by the present invention's methods also had an excellent thermal stability.

Example 6

The present invention's methods 26 to 30 were carried out as follows. Blocks obtained from ingots k to o in Table 1 was subjected to hydrogen absorption under the conditions shown in Table 23. Then, these blocks subjected to the hydrogen absorption were milled to the average particle diameters shown in Table 23 so as to produce hydrogen-absorbing rare earth magnet alloy raw material powders. To these rare earth magnet alloy raw material powders subjected to hydrogen absorption, a Dy hydride powder, a Tb hydride powder, or a Dy—Tb binary alloy hydride powder, each of which has an average particle diameter of 5 μm was added at the amount shown in Table 19, and then mixed therewith so as to produce hydrogen-containing raw material mixed powders. The respective hydrogen-containing raw material mixed powders were then subjected to, in order, hydrogen absorption-decomposition under the conditions shown in Table 23; if necessary, intermediate heat treatment under the conditions shown in Table 23; if necessary, heat treatment in depressurized hydrogen under the conditions shown in Table 23; hydrogen desorption under the conditions shown in Table 24; forcibly cooling to room temperature with Ar gas; and then pulverizing to 300 μm or below, thereby producing rare earth magnet powders.

Conventional Example 6

Conventional methods 26 to 30 were carried out as follows. Blocks obtained from ingots k to o in Table 1 were subjected to hydrogen absorption under the same conditions as in Example 6 and shown in Table 23 followed by hydrogen absorption-decomposition under the same conditions as in Example 6 and shown in Table 23 without milling the blocks nor adding a hydride powder so as not to produce a hydrogen-containing raw material mixed powder, and then were subjected to, in order, if necessary, heat treatment in depressurized hydrogen under the conditions shown in Table 23; forcibly cooling to room temperature in Ar gas; and then milling treatment to the average particle diameter shown in Table 24 so as to produce rare earth magnet raw material hydride powders. To these rare earth magnet raw material hydride powders, a Dy hydride powder, a Tb hydride powder, or a Dy—Tb binary alloy hydride powder, each of which has an average particle diameter of 5 μm, was added at the amount shown in Table 24 and then mixed therewith so as to produce hydrogen-containing raw material mixed powders. Each of these hydrogen-containing raw material mixed powders was subjected to diffusion heat-treating including heating in a vacuum followed by holding under the conditions shown in Table 24; hydrogen desorption under the conditions shown in Table 24; forcibly cooling to room temperature with Ar gas; and then pulverizing to 300 μm or below, thereby producing rare earth magnet powders.

Each of the rare earth magnet powders obtained by using the present invention's methods 26 to 30 and the conventional methods 26 to 30 was embedded in a phenolic resin and polished to a mirror surface, and the detected intensities of near-center and near-surface Dy and/or Tb, and the intensity ratio thereof were measured by analysis with the EPMA, thereby determining the values of the depth of the Dy—Tb rich layer from the surface and of the surface coverage by the Dy—Tb rich layer. Those results are given in Table 25.

To each of the rare earth magnet powders obtained in the present invention's methods 26 to 30 and the conventional methods 26 to 30, an epoxy resin was added at 3 wt % and then mixed therewith, and each of the mixtures was compression-molded in a magnetic field of 1.6 MA/m so as to produce a green compact. The green compact was hardened in an oven at 150° C. for 2 hours so as to produce a bonded magnet having a density of 6.0 to 6.1 g/cm$^3$. The magnetic properties of the obtained bonded magnet are shown in Table 26. Also, the temperature coefficient of coercivity aihC for each magnet was determined from the result of the magnetic properties measured at 150° C., and those values are shown in Table 26.

Also, to each of the rare earth magnet powders obtained in the present invention's methods 26 to 30 and the conventional methods 26 to 30, an epoxy resin was added at 3 wt % and then mixed therewith, and each of the mixtures was compression-molded while applying a magnetic field of 1.6 MA/m in a compacting direction so as to produce a green compact with a cylindrical shape having a diameter of 10 mm and a height of 7 mm. Subsequently, the obtained cylindrical green compact was hardened in an oven at 150° C. for 2 hours so as to produce a cylindrical bonded magnet having a density of 6.0 to 6.1 g/cm$^3$. To determine their magnetic properties, the obtained the bonded magnet was magnetized in pulsed magnetic field of a 70 kOe, and then held for 1,000 hours in an oven maintained at 100° C., and the thermal demagnetizing rates after 3 hours, 100 hours, and 1,000 hours were measured. Those results are shown in Table 26, and the thermal stability was evaluated.

In addition, the rare earth magnet powders obtained by using the present invention's method 26 to 30 and the conventional methods 26 to 30 were compression-molded in a magnetic field to produce anisotropic green compacts. These anisotropic green compacts were set in a hot-pressing apparatus, and hot pressing was carried out under the following conditions: pressing in parallel to the magnetic aligned direction; an Ar gas atmosphere; a temperature of 750° C.; a pressure of 58.8 MPa; and holding time of 1 minute. The hot pressing was following by quenching so as to produce hot-pressed magnets having a density of 7.5 to 7.7 g/cm$^3$. The magnetic properties of the obtained hot-pressed magnets are shown in Table 26. Also, the temperature coefficient of coercivity $\alpha_{iHc}$ was determined from the result of the magnetic properties measured at 150° C., and those values are shown in Table 26.

TABLE 23

| | Ingot | | | Average particle diameter of rare earth magnet raw material powder obtained by milling ingot in | Mixed powder Amount of hydride added to rare earth magnet raw material powder (mol %) | | | Hydrogen | Intermediate heat treatment | | | Heat treatment in depressurized hydrogen | | |
|---|---|---|---|---|---|---|---|---|---|---|---|---|---|---|
| Type | | in Table 1 | Hydrogen absorption | Table 1 in Ar atmosphere (μm) | Dy hydride | Tb hydride | Dy—Tb alloy hydride | absorption-decomposition | Ar pressure (kPa) | Holding temp. (° C.) | Holding time (min) | Hydrogen pressure (kPa) | Holding temp. (° C.) | Holding time (min) |
| Invention's method | 26 | k | Hydrogen partial pressure: 200 kPa | 10 | 0.5 | — | — | Hydrogen partial pressure: 200 kPa | 200 | 820 | 5 | 3.9 | 820 | 120 |
| Conventional method | | | | — | | — | | | — | — | — | | | |
| Invention's method | 27 | l | Holding temp.: 150° C. Holding time: 20 min | 50 | — | — | 1.5 | Holding temp.: 820° C. Holding time: 120 min | — | — | — | 3.9 | 820 | 120 |
| Conventional method | | | | — | | — | | | | | | | | |
| Invention's method | 28 | m | | 100 | 1.0 | 1.0 | — | | 200 | 820 | 5 | — | — | — |
| Conventional method | | | | — | | — | | | | — | — | 3.9 | 820 | 120 |
| Invention's method | 29 | n | | 200 | — | 2.0 | 2.0 | | — | — | — | — | — | — |
| Conventional method | | | | — | | — | | | | | | 3.9 | 820 | 120 |
| Invention's method | 30 | o | | 500 | 2.0 | — | — | | 200 | 820 | 5 | 3.9 | 820 | 120 |
| Conventional method | | | | — | | — | | | — | — | — | | | |

TABLE 24

| Type | Remarks | Average particle diameter of rare earth magnet raw material hydride powder obtained by heat-treating ingot in Table 1 in depressurized hydrogen, then milling (μm) | Hydrogen-containing raw material mixed powder Amount of Dy/Tb hydride added to rare earth magnet raw material hydride powder (mol %) | | | Diffusion heat-treatment | | | Hydrogen desorption | | |
|---|---|---|---|---|---|---|---|---|---|---|---|
| | | | Dy hydride | Tb hydride | Dy—Tb alloy hydride | Pressure (kPa) | Holding temp. (° C.) | Holding time (min) | Ultimate pressure (kPa) | Holding temp. (° C.) | Holding time (min) |
| Invention's method | 26 Continued from Table 23 | — | | — | | | — | | 0.013 | 820 | 8 |
| Conventional method | | 10 | 0.5 | — | — | $1 \times 10^{-4}$ | 820 | 30 | $1 \times 10^{-4}$ | | 30 |
| Invention's method | 27 | — | | — | | | — | | 0.013 | | 13 |
| Conventional method | | 50 | — | — | 1.5 | $1 \times 10^{-4}$ | 820 | 30 | $1 \times 10^{-4}$ | | 30 |
| Invention's method | 28 | — | | — | | | — | | 0.013 | | 7 |
| Conventional method | | 100 | 1 | 1 | — | $1 \times 10^{-4}$ | 820 | 30 | $1 \times 10^{-4}$ | | 30 |
| Invention's method | 29 | — | | — | | | — | | 0.013 | | 9 |
| Conventional method | | 200 | — | 2 | 2 | $1 \times 10^{-4}$ | 820 | 30 | $1 \times 10^{-4}$ | | 30 |
| Invention's method | 30 | — | | — | | | — | | 0.013 | | 12 |
| Conventional method | | 500 | 2 | — | — | $1 \times 10^{-4}$ | 820 | 30 | $1 \times 10^{-4}$ | | 30 |

TABLE 25

| Type | Remarks | Rare earth magnet powder | | | | |
|---|---|---|---|---|---|---|
| | | EPMA detected intensity | | | Thickness | |
| | | Peak value near surface (counts) | Peak value near center (counts) | Intensity ratio | of Dy—Tb rich layer (μm) | Coverage (%) |
| Invention's method | 26 Continued from Table 24 | 2363 | 1524 | 1.55 | 4.9 | 90 |
| Conventional method | | 1760 | 1752 | 1.00 | — | 0 |
| Invention's method | 27 | 2974 | 1383 | 2.15 | 8.0 | 100 |
| Conventional method | | 2253 | 2067 | 1.09 | — | 0 |
| Invention's method | 28 | 2654 | 1270 | 2.09 | 11.6 | 100 |
| Conventional method | | 2017 | 1817 | 1.11 | — | 0 |
| Invention's method | 29 | 8711 | 2257 | 3.86 | 21.4 | 100 |
| Conventional method | | 4054 | 3350 | 1.21 | 0.5 | 10 |
| Invention's method | 30 | 2939 | 893 | 3.29 | 12.2 | 100 |
| Conventional method | | 1627 | 1440 | 1.13 | — | 0 |

TABLE 26

| Type | | Bonded magnet Br (T) | iHc (MA/m) | BHmax (KJ/m³) | $\alpha_{iHc}$ (%/° C.) | Hot-pressed magnet Br (T) | iHc (MA/m) | BHmax (KJ/m³) | $\alpha_{iHc}$ (%/° C.) | Thermal demagnetizing rate for bonded magnet after being held for time indicated below in 100° C. oven (%) 3 hours | 100 hours | 1,000 hours |
|---|---|---|---|---|---|---|---|---|---|---|---|---|
| Invention's method | 26 | 0.95 | 1.69 | 161 | −0.39 | 1.20 | 1.68 | 257 | −0.42 | −5.2 | −5.9 | −7.0 |
| Conventional method | | 0.93 | 1.61 | 152 | −0.42 | 1.18 | 1.59 | 247 | −0.45 | −5.8 | −7.8 | −11.5 |
| Invention's method | 27 | 0.94 | 1.72 | 159 | −0.37 | 1.18 | 1.70 | 250 | −0.40 | −5.1 | −5.8 | −6.9 |
| Conventional method | | 0.92 | 1.58 | 150 | −0.43 | 1.17 | 1.56 | 242 | −0.46 | −5.9 | −7.9 | −11.7 |
| Invention's method | 28 | 0.96 | 1.46 | 172 | −0.36 | 1.22 | 1.44 | 265 | −0.39 | −6.0 | −6.9 | −8.1 |
| Conventional method | | 0.95 | 1.31 | 165 | −0.44 | 1.20 | 1.30 | 258 | −0.47 | −7.1 | −9.5 | −14.1 |
| Invention's method | 29 | 0.95 | 2.11 | 166 | −0.36 | 1.20 | 2.09 | 257 | −0.39 | −4.1 | −4.7 | −5.6 |
| Conventional method | | 0.94 | 1.79 | 161 | −0.43 | 1.19 | 1.77 | 252 | −0.46 | −5.3 | −7.0 | −10.3 |
| Invention's method | 30 | 0.97 | 1.42 | 180 | −0.36 | 1.23 | 1.41 | 271 | −0.39 | −6.2 | −7.0 | −8.3 |
| Conventional method | | 0.96 | 1.23 | 172 | −0.45 | 1.22 | 1.22 | 263 | −0.48 | −7.6 | −10.1 | −15.0 |

On the basis of the results shown in Table 1 and Table 23 to 26, the magnetic properties of the bonded magnets and the hot-pressed magnets produced by using the rare earth magnet powders produced by the present invention's methods 26 to 30, in which a hydrogen-containing raw material mixed powder was produced by adding a hydride powder to a hydrogen-absorbing rare earth magnet raw material powder, and this hydrogen-containing raw material mixed powder was subjected to hydrogen absorption-decomposition, showed improvements in both coercivity and remanence when compared with the magnetic properties of bonded magnets and hot-pressed magnets produced by using the rare earth magnet powders produced by the conventional methods 26 to 30 in which a hydrogen-containing raw material mixed powder was obtained by adding a hydride powder to a rare earth magnet raw material hydride powder obtained by hydrogen absorption followed by hydrogen absorption-decomposition, and this hydrogen-containing raw material mixed powder was diffusion heat-treated. Moreover, the temperature coefficient of the coercivity and the thermal demagnetizing rate were both small, indicating that each of the magnets obtained by the present invention's methods also had an excellent thermal stability.

INDUSTRIAL APPLICABILITY

The rare earth magnet powders obtained by the methods of producing a rare earth magnet powder of the present invention are excellent in magnetic anisotropy and thermal stability, and thus exhibit outstanding effects in industrial use.

The invention claimed is:

1. A rare earth magnet powder comprising:

a chemical composition comprising R: 5 to 20 atom % (wherein R represents one, or two or more rare earth elements being inclusive of Y but exclusive of Dy and Tb), one or both of Dy and Tb: 0.01 to 10 atom %, and B: 3 to 20 atom %, with the balance comprising Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

2. A rare earth magnet powder comprising:

a chemical composition comprising R: 5 to 20 atm % (wherein R represents one, or two or more rare earth elements being inclusive of Y but exclusive of Dy and Tb), one or both of Dy and Tb: 0.01 to 10 atm %, B: 3 to 20 atm %, and M: 0.001 to 5 atm % (wherein M represents one, or two or more from among Ga, Zr, Nb, Mo, Hf, Ta, W, Ni, Al, Ti, V, Cu, Cr, Ge, C, and Si), with the balance comprising Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

3. A rare earth magnet powder comprising:

a chemical composition comprising R: 5 to 20 atm % (wherein R represents one, or two or more rare earth elements being inclusive of Y but exclusive of Dy and Tb), Co: 0.1 to 50 atm %, one or both of Dy and Tb: 0.01 to 10 atm %, and B: 3 to 20 atm %, with the balance comprising Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

4. A rare earth magnet powder comprising:

a chemical composition comprising R: 5 to 20 atm % (wherein M represents one, or two or more from among Ga, Zr, Nb, Mo, Hf, Ta, W, Ni, Al, Ti, V, Cu, Cr, Ge, C, and Si), one or both of Dy and Tb: 0.01 to 10 atm %, Co: 0.1 to 50 atm %, B: 3 to 20 atm %, and M: 0.001 to 5 atm % (wherein M represents one, or two or more from among Ga, Zr, Nb, Mo, Hf, Ta, W, Ni, Al, Ti, V, Cu, Cr, Ge, C, and Si), with the balance comprising Fe and inevitable impurities, an average particle diameter being 10 to 1,000 μm, wherein 70% or more of the entire surface of the rare earth magnet powder is covered with a Dy—Tb rich layer being rich in content of the one or both of Dy and Tb and having a thickness of 0.05 to 50 μm, and a concentration of the one or both of Dy and Tb in the Dy—Tb rich layer is such that the maximum detected intensity of the one or both of Dy and Tb, as measured by wavelength dispersive X-ray spectroscopy, is 1.2 to 5 times the average detected intensity in the central portion being present in the range of ⅓ of the particle diameter of a particle of the rare earth magnet powder.

5. A rare earth magnet powder which is excellent in magnetic anisotropy and thermal stability according to any one of claims 1 to 4, further comprising:

a recrystallization texture in which recrystallized grains, whose main phase is a $R_2Fe_{14}B$ intermetallic compound phase that is substantially a tetragonal structure, are adjacent to each other, wherein the recrystallization texture comprises a basic texture of a magnetically anisotropic HDDR magnet powder in which the recrystallized grains, whose ratio (b/a) of a longest particle diameter (b) to a shortest particle diameter (a) is less than 2, exists at 50 vol % or more of all the recrystallized grains and an average recrystallized grain diameter of the recrystallized grains is 0.05 to 5 μm.

6. A rare earth magnet produced by binding a rare earth magnet powder which is excellent in magnetic anisotropy and thermal stability according to any one of claims 1 to 4 with an organic binder or a metal binder.

7. A rare earth magnet produced by processing a rare earth magnet powder which is excellent in magnetic anisotropy and thermal stability according to any one of claims 1 to 4 with hot pressing or hot isostatic pressing.

* * * * *